US009593864B2

(12) United States Patent
Yasutomi et al.

(10) Patent No.: US 9,593,864 B2
(45) Date of Patent: Mar. 14, 2017

(54) AIRFLOW DIRECTION CONTROL DEVICE FOR AIR CONDITIONING INDOOR UNIT

(75) Inventors: Masanao Yasutomi, Kusatsu (JP); Masashi Kamada, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/354,556

(22) PCT Filed: Aug. 31, 2012

(86) PCT No.: PCT/JP2012/072145

§ 371 (c)(1),
(2), (4) Date: Apr. 25, 2014

(87) PCT Pub. No.: WO2013/065395

PCT Pub. Date: May 10, 2013

(65) Prior Publication Data

US 2015/0087219 A1 Mar. 26, 2015

(30) Foreign Application Priority Data

Oct. 31, 2011 (JP) ..... 2011-239781

(51) Int. Cl.
*F24F 13/08* (2006.01)
*F24F 11/00* (2006.01)
*F24F 1/00* (2011.01)

(52) U.S. Cl.
CPC ..... *F24F 13/08* (2013.01); *F24F 11/0078* (2013.01); *F24F 1/0011* (2013.01); *F24F 2001/0048* (2013.01); *F24F 2221/28* (2013.01)

(58) Field of Classification Search
CPC ..... F24F 2221/28; F24F 11/0078
See application file for complete search history.

(56) References Cited

U.S. PATENT DOCUMENTS 4,515,069 A * 5/1985 Kline ..... F24F 11/053 454/258
4,570,533 A * 2/1986 Sugawara et al. ..... 454/319
(Continued)

FOREIGN PATENT DOCUMENTS

EP 1 553 361 A1 7/2005
EP 1 707 892 A1 10/2006
(Continued)

OTHER PUBLICATIONS

Kumamoto, JP 2011-069591A English machine translation, Apr. 7, 2011.*

(Continued)

*Primary Examiner* — Alissa Tompkins
*Assistant Examiner* — Phillip E Decker
(74) *Attorney, Agent, or Firm* — Global IP Counselors

(57) ABSTRACT

An air-conditioning indoor unit causes a flow of air blown out from a blow-out port to be diverted in a predetermined direction due to the Coandă effect. The air-conditioning indoor unit includes an airflow direction adjustment vane varying a blowout angle of blown air relative to a horizontal plane, a Coandă vane turning the blown air into a Coandă airflow along a bottom surface, and a control unit. The Coandă vane is provided in proximity to the blow-out port. The control unit executes an airflow direction automatic switching mode automatically switching between a Coandă effect use state in which the blown air is turned into a Coandă airflow along a predetermined surface and diverted in the predetermined direction, and a normal state in which the Coandă airflow is not created. The airflow direction adjustment vane and the Coandă vane having incline angles relative to a horizontal plane that are variable.

23 Claims, 14 Drawing Sheets

(56) References Cited

U.S. PATENT DOCUMENTS

| | | | | |
|---|---|---|---|---|
| 5,063,786 | A * | 11/1991 | Sanderson et al. | 73/861.19 |
| 5,810,661 | A * | 9/1998 | Bang | 454/286 |
| 6,582,294 | B2 * | 6/2003 | Butera et al. | 454/155 |
| 7,232,367 | B2 * | 6/2007 | Butera | B60H 1/00664 454/127 |
| 7,314,188 | B2 * | 1/2008 | Watson et al. | 239/568 |
| 2006/0196872 | A1 * | 9/2006 | Yan | F04D 25/105 219/753 |
| 2009/0100858 | A1 * | 4/2009 | Park | F24F 1/0007 62/404 |
| 2012/0174608 | A1 * | 7/2012 | Kumamoto et al. | 62/186 |
| 2014/0227961 | A1 * | 8/2014 | Yasutomi et al. | 454/325 |
| 2014/0273805 | A1 * | 9/2014 | Yasutomi et al. | 454/322 |
| 2014/0308888 | A1 * | 10/2014 | Yasutomi et al. | 454/284 |
| 2015/0153063 | A1 * | 6/2015 | Yasutomi | F24F 1/0011 454/333 |

FOREIGN PATENT DOCUMENTS

| | | | | |
|---|---|---|---|---|
| JP | 54060663 | A * | 5/1979 | |
| JP | 54108175 | A * | 8/1979 | |
| JP | 57-169525 | A | 10/1982 | |
| JP | 6-265168 | A | 9/1994 | |
| JP | 2004012060 | A * | 1/2004 | |
| JP | 2004-101128 | A | 4/2004 | |
| JP | 2004361011 | A * | 12/2004 | |
| JP | 2005-121316 | A | 5/2005 | |
| JP | 2002-61938 | A | 2/2006 | |
| JP | 2007-192480 | A * | 8/2007 | |
| JP | 2011069591 | A * | 4/2011 | |
| WO | WO 2011007520 | A1 * | 1/2011 | F24F 1/0011 |

OTHER PUBLICATIONS

Ota, et al., JP 2004-361011 A English machine translation, Dec. 24, 2004.*

International Preliminary Report on Patentability, PCT/JP2012/072145, May 15, 2014.*

European Search Report of corresponding EP Application No. 12 84 5946.8 dated Oct. 21, 2014.

* cited by examiner

AIRFLOW DIRECTION CONTROL DEVICE FOR AIR CONDITIONING INDOOR UNIT

CROSS-REFERENCE TO RELATED APPLICATIONS

This U.S. National stage application claims priority under 35 U.S.C. §119(a) to Japanese Patent Application Nos. 2011-239781, filed in Japan on Oct. 31, 2011, the entire contents of which are hereby incorporated herein by reference.

TECHNICAL FIELD

The present invention relates to an air-conditioning indoor unit.

BACKGROUND ART

Commonly, the airflow direction of blown air in an air conditioner is adjusted by vertically inclining an airflow direction adjustment vane disposed in a blow-out port. Because an airflow direction that sends blown air at a person is uncomfortable, research pertaining to airflow direction has tended to focus exclusively on making the temperature distribution in an entire room uniform. In the air conditioner disclosed in Japanese Laid-open Patent Application No. 2002-61938, for example, a front surface inclined part of a front surface panel has a shape that is gently inclined toward the ceiling. When conditioned air blown out from the blow-out port is deflected to the front surface inclined part by a vertical airflow direction plate, the conditioned air is led toward the ceiling along the front surface inclined part. As a result, the conditioned air can reach further along the ceiling surface, and the temperature distribution of the entire room is made uniform.

SUMMARY

Technical Problem

However, there has recently been a greater need to create a more natural irregular (sudden) airflow. In air conditioners such as the one described above, even if the airflow direction adjustment vane is actuated automatically, it is a way for the airflow to gradually come closer and gradually go further away, which does not meet said need.

An object of the present invention is to provide an air-conditioning indoor unit that can instantly vary airflow direction and can create a more natural irregular airflow.

Solution to Problem

An air-conditioning indoor unit according to a first aspect of the present invention is an air-conditioning indoor unit capable of causing a flow of blown air blown out from a blow-out port to be diverted in a predetermined direction due to the Coandă effect, the air-conditioning indoor unit comprising a control unit for executing an airflow direction automatic switching mode. The airflow direction automatic switching mode is a mode of automatically switching between a Coandă effect use state in which the blown air is turned into a Coandă airflow along a predetermined surface and diverted in a predetermined direction, and a normal state in which a Coandă airflow is not created.

In this air-conditioning indoor unit, the airflow direction can be changed instantly by creating a Coandă effect of causing the blown air to adhere to a predetermined surface. This is useful when switching between an airflow that contacts a person and an airflow that does not contact a person, for example.

An air-conditioning indoor unit according to a second aspect of the present invention is the air-conditioning indoor unit according to the first aspect, further comprising a Coandă vane. The Coandă vane is provided in proximity to the blow-out port, and the Coandă vane turns the blown air into a Coandă airflow along the bottom surface thereof.

In this air-conditioning indoor unit, a downward airflow direction can be switched to horizontal or an upward airflow direction, and it is therefore easy to switch between an airflow that contacts a person and an airflow that does not contact a person, for example.

An air-conditioning indoor unit according to a third aspect of the present invention is the air-conditioning indoor unit according to the second aspect, wherein the control unit controls the orientation of the Coandă vane in the airflow direction automatic switching mode to switch between the Coandă effect use state and the normal state.

In this air-conditioning indoor unit, because the Coandă vane changes orientations, when the Coandă vane is positioned higher than the blow-out port, for example, downward blown air can be instantly switched to a horizontally blown Coandă airflow, or horizontally blown air can be instantly switched to an upward blown Coandă airflow.

An air-conditioning indoor unit according to a fourth aspect of the present invention is the air-conditioning indoor unit according to the second aspect, further comprising a movable member provided in proximity to the blow-out port. The control unit controls the orientation of the movable member in the airflow direction automatic switching mode to switch between the Coandă effect use state and the normal state.

In this air-conditioning indoor unit, because the movable member changes orientations, when the Coandă vane is positioned higher than the movable member, for example, the blown air is switched instantly to a horizontally blown Coandă airflow or an upward blown Coandă airflow by a process of gradually changing the blown air from downward blowing to upward blowing.

An air-conditioning indoor unit according to a fifth aspect of the present invention is the air-conditioning indoor unit according to the second aspect, further comprising a movable member provided in proximity to the blow-out port. The control unit controls the orientation of the movable member and the Coandă vane in the airflow direction automatic switching mode to switch between the Coandă effect use state and the normal state.

In this air-conditioning indoor unit, because the movable member and the Coandă vane change orientations, when the Coandă vane is positioned higher and further forward than the movable member, for example, the blown air is switched instantly to a horizontally blown Coandă airflow or an upward blown Coandă airflow by a process of gradually changing the blown air from downward blowing to upward blowing and causing the Coandă vane to gradually approach the blown air.

An air-conditioning indoor unit according to a sixth aspect of the present invention is the air-conditioning indoor unit according to the fourth aspect, wherein the control unit stops the action of the movable member and changes the orientation of the Coandă vane in the airflow direction automatic switching mode so that the Coandă vane spans the boundary between an area where a Coandă effect is created and an area where a Coandă effect is not created.

In this air-conditioning indoor unit, the position and incline angle of the Coandă vane are changed by changing the orientation of the Coandă vane. For example, when the Coandă vane is brought nearer to the blown air while the orientation is changed, the blown air is drawn toward the surface (bottom surface) of the Coandă vane with the Coandă vane in a position somewhat near to the blown air, and the blown air switches to a Coandă airflow along this surface. Conversely, when the orientation of the Coandă vane is changed in a direction of separating from the original blown air, the Coandă airflow is instantly dispelled and switched to the original blown air with the Coandă vane in a somewhat separated position.

An air-conditioning indoor a nit according to a seventh aspect of the present invention is the air-conditioning indoor unit according to the fourth aspect, wherein the control unit stops the action of the Coandă vane and changes the orientation of the movable member in the airflow direction automatic switching mode so that the movable member spans the boundary between an area where a Coandă effect is created and an area where a Coandă effect is not created.

In this air-conditioning indoor unit, when the blown air is deflected nearer to the Coandă vane by the movable member, the blown air is drawn toward the surface of the Coandă vane when somewhat near the Coandă vane, and the blown air switches to a Coandă airflow along the surface thereof. Conversely, when the orientation of the movable member is changed so that the blown air separates from the Coandă vane, the Coandă airflow is instantly dispelled and switched to the blown air in a somewhat separated position.

An air-conditioning indoor unit according to an eighth aspect of the present invention is the air-conditioning indoor unit according to the fourth aspect, wherein the control unit changes the orientations of the movable member and the Coandă vane in the airflow direction automatic switching mode so that the movable member and the Coandă vane span the boundary between an area where a Coandă effect is created and an area where a Coandă effect is not created.

In this air-conditioning indoor unit, when the orientations of the movable member and the Coandă vane are controlled so that the Coandă vane and the blown air whose airflow direction is adjusted by the movable member draw nearer to each other, the blown air is drawn toward the surface of the Coandă vane when somewhat near the Coandă vane, and the blown air switches to a Coandă airflow along the surface thereof. Conversely, when the orientations of the movable member and the Coandă vane are controlled so that the Coandă vane and the blown direction due to the movable member become distanced from each other, the Coandă airflow is instantly dispelled and switched to the blown air with the two components in somewhat distanced positioned from each other.

An air-conditioning indoor unit according to a ninth aspect of the present invention is the air-conditioning indoor unit according to any of the first through fifth aspects, wherein the control unit irregularly switches between the Coandă effect use state and the normal state in the airflow direction automatic switching mode. In this air-conditioning indoor unit, a more natural irregular airflow can be created.

An air-conditioning indoor unit according to a tenth aspect of the present invention is the air-conditioning indoor unit according to any of the first through fifth aspects, wherein the control unit regularly switches between the Coandă effect use state and the normal state in the airflow direction automatic switching mode. In this air-conditioning indoor unit, a more natural sudden airflow can be regularly created.

An air-conditioning indoor unit according to an eleventh aspect of the present invention is the air-conditioning indoor unit according to any of the first through tenth aspects, further comprising a person position detection sensor for detecting the position of a person. In the airflow direction automatic switching mode, the airflow direction of the blown air is generally toward the floor in the normal state. The airflow direction is determined based on a detection signal from the person position detection sensor. In this air-conditioning indoor unit, it is possible to automatically detect whether a person is present and automatically sent an airflow resembling a natural airflow to the person.

An air-conditioning indoor unit according to a twelfth aspect of the present invention is the air-conditioning indoor unit according to the first aspect, further comprising an airflow direction adjustment vane and a Coandă vane. The airflow direction adjustment vane varies the blowout angle of blown air relative to a horizontal plane. The Coandă vane, which is provided in proximity to the blow-out port, turns the blown air into a Coandă airflow along a bottom surface thereof. It is possible to vary the incline angle of the Coandă vane (32) relative to a horizontal plane. When the airflow direction automatic switching mode is executed, the control unit keeps the Coandă vane stationary in a predetermined stationary position and continuously varies the direction of the blown air in a predetermined vertical range via the airflow direction adjustment vane so that the Coandă effect use state and the normal state are alternated.

In this air-conditioning indoor unit, due to the direction of the blown air being varied vertically, an occupant of the room feels that the airflow gradually comes closer and gradually goes further away. By coming in contact with the stationary Coandă vane, the blown air becomes a Coandă airflow and heads in a direction that does not contact the occupant of the room, and the occupant therefore feels that the airflow has suddenly stopped. Furthermore, when the blown air separates from the stationary Coandă vane, the Coandă airflow is dispelled and the occupant feels that an airflow has started to be blown unexpectedly.

An air-conditioning indoor unit according to a thirteenth aspect of the present invention is the air-conditioning indoor unit according to the twelfth aspect, wherein the control unit shifts the stationary position of the Coandă vane when the number of variations of the direction of the blown air reaches a predetermined number.

In this air-conditioning indoor unit, the timing at which the blown air comes in contact with the Coandă vane and becomes a Coandă airflow is different from the previous instance, the timing at which the airflow contacts the occupant is therefore irregular, and this feeling of irregularity brings the airflow more closer to a natural airflow.

An air-conditioning indoor unit according to a fourteenth aspect of the present invention is the air-conditioning indoor unit according to the first aspect, further comprising an airflow direction adjustment vane and a Coandă vane. The airflow direction adjustment vane varies the blowout angle of blown air relative to a horizontal plane. The Coandă vane, which is provided in proximity to the blow-out port, turns the blown air into a Coandă airflow along a bottom surface thereof. It is possible to vary the incline angle of the Coandă vane relative to a horizontal plane. When the airflow direction automatic switching mode is executed, the control unit keeps the airflow direction adjustment vane stationary in a predetermined stationary position and continuously varies the direction of the blown air in a predetermined vertical range via the Coandă vane so that the Coandă effect use state and the normal state are alternated.

In this air-conditioning indoor unit, when the blown air is oriented toward the occupant of the room by the airflow direction adjustment vane, the vertical variation of the incline angle of the Coandă vane causes the blown air to come in contact with the Coandă vane, becoming a Coandă airflow and heading in another direction not contacting the occupant, and the occupant therefore feels that the airflow has suddenly stopped. The Coandă vane then moves away from the blown air, thereby dispelling the Coandă airflow and causing the blown air to again contact the occupant, who therefore feels that an airflow has started to be blown unexpectedly.

An air-conditioning indoor unit according to a fifteenth aspect of the present invention is the air-conditioning indoor unit according to the fourteenth aspect, wherein the control unit shifts the direction of the blown air when the number of cycles of varying the incline angle of the Coandă vane reaches a predetermined number.

In this air-conditioning indoor unit, the timing at which the blown air comes in contact with the Coandă vane and becomes a Coandă airflow is different from the previous instance, the timing at which the airflow contacts the occupant is therefore irregular, and this feeling of irregularity brings the airflow more closer to a natural airflow.

An air-conditioning indoor unit according to a sixteenth aspect of the present invention is the air-conditioning indoor unit according to the first aspect, further comprising an airflow direction adjustment vane and a Coandă vane. The airflow direction adjustment vane varies the blowout angle of blown air relative to a horizontal plane. The Coandă vane, which is provided in proximity to the blow-out port, turns the blown air into a Coandă airflow along a bottom surface thereof. It is possible to vary the incline angle of the Coandă vane relative to a horizontal plane. When the airflow direction automatic switching mode is executed, the control unit continuously varies the direction of the blown air in a predetermined vertical range via the airflow direction adjustment vane, and continuously varies the incline angle of the Coandă vane in a predetermined vertical range, so that the Coandă effect use state and the normal state are alternated.

In this air-conditioning indoor unit, due to the vertical variation of the direction of the blown air, the occupant of the room feels that the airflow gradually comes closer and gradually goes further away. The blown air comes in contact with the Coandă vane, thereby becoming a Coandă airflow and heading in a direction not contacting the occupant, and the occupant therefore feels that the airflow has suddenly stopped. Furthermore, when the blown air separates from the Coandă vane, the Coandă airflow is dispelled and the occupant feels that an airflow has started to be blown unexpectedly.

Advantageous Effects of Invention

In the air-conditioning indoor unit according to the first aspect of the present invention, the airflow direction can be changed instantly by creating a Coandă effect of causing the blown air to adhere to a predetermined surface. This is useful when switching between an airflow that contacts a person and an airflow that does not contact a person, for example.

In the air-conditioning indoor unit according to the second aspect of the present invention, a downward airflow direction can be switched to horizontal or an upward airflow direction, and it is therefore easy to switch between an airflow that contacts a person and an airflow that does not contact a person, for example.

In the air-conditioning indoor unit according to the third aspect of the present invention, because the Coandă vane changes orientations, when the Coandă vane is positioned higher than the blow-out port, for example, downward blown air can be instantly switched to a horizontally blown Coandă airflow, or horizontally blown air can be instantly switched to an upward blown Coandă airflow.

In the air-conditioning indoor unit according to the fourth aspect of the present invention, because the movable member changes orientations, when the Coandă vane is positioned higher than the movable member, for example, the blown air is switched instantly to a horizontally blown Coandă airflow or an upward blown Coandă airflow by a process of gradually changing the blown air from downward blowing to upward blowing.

In the air-conditioning indoor unit according to the fifth aspect of the present invention, because the movable member and the Coandă vane change orientations, when the Coandă vane is positioned higher and further forward than the movable member, for example, the blown air is switched instantly to a horizontally blown Coandă airflow or an upward blown Coandă airflow by a process of gradually changing the blown air from downward blowing to upward blowing and causing the Coandă vane to gradually approach the blown air.

In the air-conditioning indoor unit according to the sixth aspect of the present invention, the position and incline angle of the Coandă vane are changed by changing the orientation of the Coandă vane. For example, when the Coandă vane is brought nearer to the blown air while the orientation is changed, the blown air is drawn toward the surface (bottom surface) of the Coandă vane with the Coandă vane in a position somewhat near to the blown air, and the blown air switches to a Coandă airflow along this surface. Conversely, when the orientation of the Coandă vane is changed in a direction of separating from the original blown air, the Coandă airflow is instantly dispelled and switched to the original blown air with the Coandă vane in a somewhat separated position.

In the air-conditioning indoor unit according to the seventh aspect of the present invention, when the blown air is deflected nearer to the Coandă vane by the movable member, the blown air is drawn toward the surface of the Coandă vane when somewhat near the Coandă vane, and the blown air switches to a Coandă airflow along the surface thereof. Conversely, when the orientation of the movable member is changed so that the blown air separates from the Coandă vane, the Coandă airflow is instantly dispelled and switched to the blown air in a somewhat separated position.

In the air-conditioning indoor unit according to the eighth aspect of the present invention, when the orientations of the movable member and the Coandă vane are controlled so that the Coandă vane and the blown air whose airflow direction is adjusted by the movable member draw nearer to each other, the blown air is drawn toward the surface of the Coandă vane when somewhat near the Coandă vane, and the blown air switches to a Coandă airflow along the surface thereof. Conversely, when the orientations of the movable member and the Coandă vane are controlled so that the Coandă vane and the blown direction due to the movable member become distanced from each other, the Coandă airflow is instantly dispelled and switched to the blown air with the two components positioned somewhat distanced from each other.

In the air-conditioning indoor unit according to the ninth aspect of the present invention, a more natural irregular airflow can be created.

In the air-conditioning indoor unit according to the tenth aspect of the present invention, a more natural sudden airflow can be regularly created.

In the air-conditioning indoor unit according to the eleventh aspect of the present invention, it is possible to automatically detect whether a person is present and automatically send an airflow resembling a natural airflow to the person.

In the air-conditioning indoor unit according to the twelfth aspect of the present invention, due to the direction of the blown air being varied vertically, an occupant of the room feels that the airflow gradually comes closer and gradually goes further away. By coming in contact with the stationary Coandă vane, the blown air becomes a Coandă airflow and heads in a direction that does not contact the occupant of the room, and the occupant therefore feels that the airflow has suddenly stopped. Furthermore, when the blown air separates from the stationary Coandă vane, the Coandă airflow is dispelled and the occupant feels that an airflow has started to be blown unexpectedly.

In the air-conditioning indoor unit according to the thirteenth aspect of the present invention, the timing at which the blown air comes in contact with the Coandă vane and becomes a Coandă airflow is different from the previous instance, the timing at which the airflow contacts the occupant is therefore irregular, and this feeling of irregularity brings the airflow more closer to a natural airflow.

In the air-conditioning indoor unit according to the fourteenth aspect of the present invention, when the blown air is oriented toward the occupant of the room by the airflow direction adjustment vane, the vertical variation of the incline angle of the Coandă vane causes the blown air to come in contact with the Coandă vane, becoming a Coandă airflow and heading in another direction not contacting the occupant, and the occupant therefore feels that the airflow has suddenly stopped. The Coandă vane then moves away from the blown air, thereby dispelling the Coandă airflow and causing the blown air to again contact the occupant, who therefore feels that an airflow has started to be blown unexpectedly.

In the air-conditioning indoor unit according to the fifteenth aspect of the present invention, the timing at which the blown air comes in contact with the Coandă vane and becomes a Coandă airflow is different from the previous instance, the timing at which the airflow contacts the occupant is therefore irregular, and this feeling of irregularity brings the airflow more closer to a natural airflow.

In the air-conditioning indoor unit according to the sixteenth aspect of the present invention, due to the vertical variation of the direction of the blown air, the occupant of the room feels that the airflow gradually comes closer and gradually goes further away. The blown air comes in contact with the Coandă vane, thereby becoming a Coandă airflow and heading in a direction not contacting the occupant, and the occupant therefore feels that the airflow has suddenly stopped. Furthermore, when the blown air separates from the Coandă vane, the Coandă airflow is dispelled and the occupant feels that an airflow has started to be blown unexpectedly.

DESCRIPTION OF EMBODIMENTS

Embodiments of the present invention are described below with reference to the drawings. The following embodiments are specific examples of the present invention and are not intended to limit the technical scope of the present invention.

(1) Configuration of Air-Conditioning Indoor Unit 10

Figure 1:
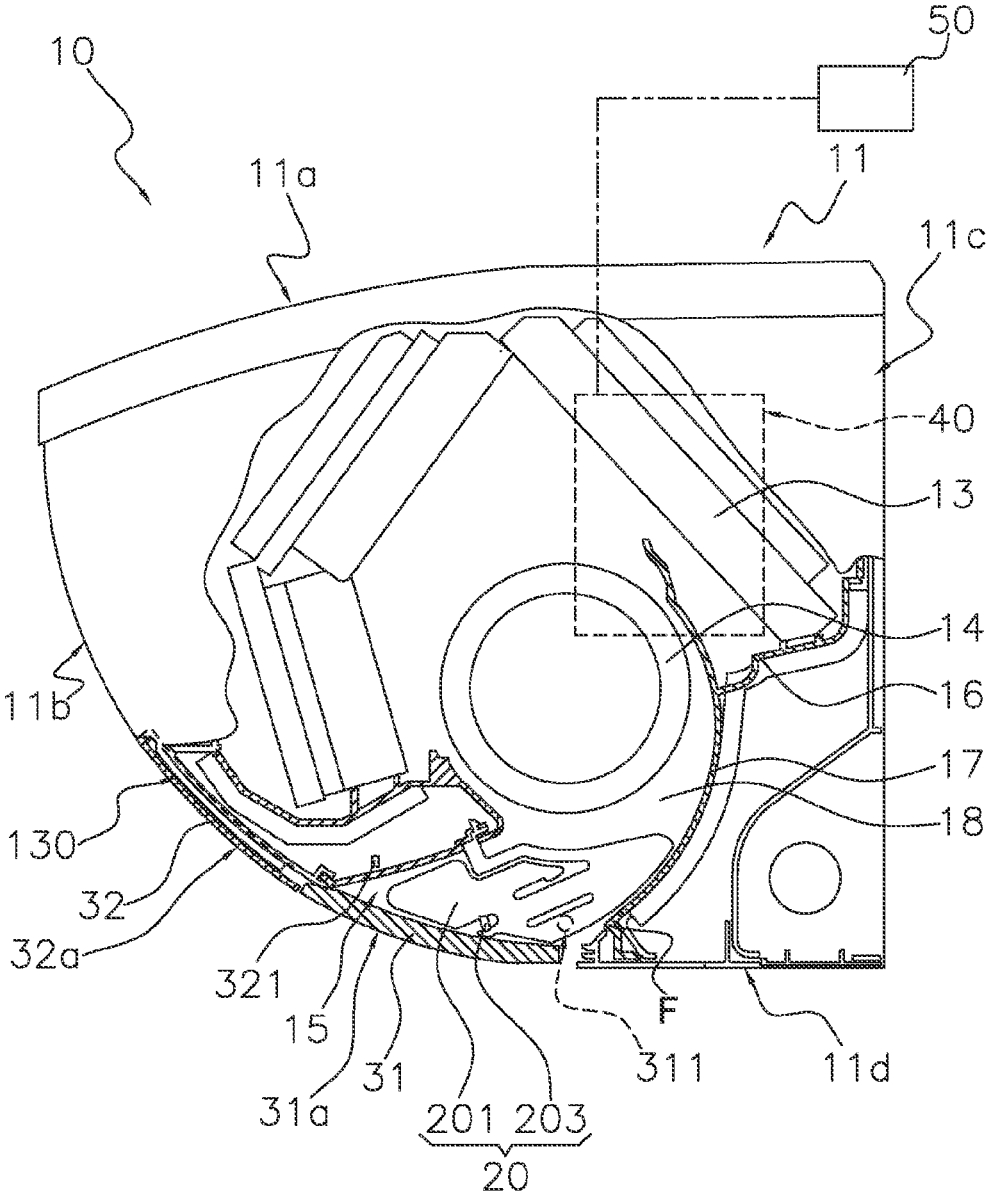
FIG. 1 is a cross-sectional view of an air-conditioning indoor unit according to an embodiment of the present invention when operation has stopped.
Figure 2:
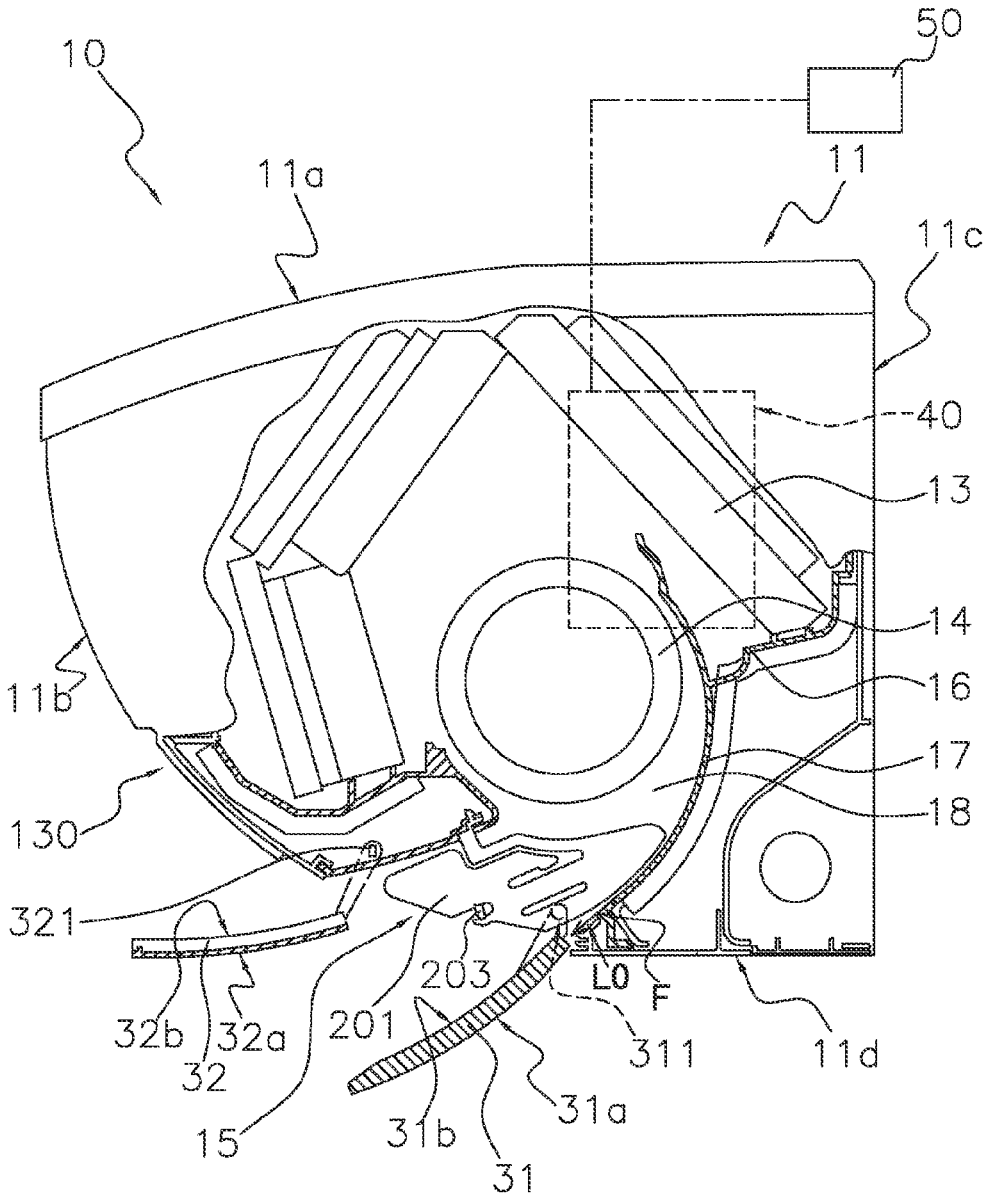
FIG. 2 is a cross-sectional view of the air-conditioning indoor unit while operating.

FIG. 1 is a cross-sectional view of an air-conditioning indoor unit 10 according to an embodiment of the present invention when operation has stopped. FIG. 2 is a cross-sectional view of the air-conditioning indoor unit 10 while operating. In FIGS. 1 and 2, the air-conditioning indoor unit 10 is a wall-mounted type unit, equipped with a main body casing 11, an indoor heat exchanger 13, an indoor fan 14, a bottom frame 16, and a control unit 40.

The main body casing 11 has a top surface part 11*a*, a front surface panel 11*b*, a back surface plate 11*c*, and a bottom horizontal plate 11*d*, and the interior of the casing accommodates the indoor heat exchanger 13, the indoor fan 14, the bottom frame 16, and the control unit 40.

The top surface part 11*a* is positioned in the top of the main body casing 11 and an intake port (not shown is provided in the front of the top surface part 11*a*.

The front surface panel 11*b* constitutes the front surface part of the indoor unit, and has a flat shape with no intake port. The front surface panel 11*b* is also turnably supported at the top end on the top surface part 11*a*, and can be actuated in the manner of a hinge.

The indoor heat exchanger 13 and the indoor fan 14 are attached to the bottom frame 16. The indoor heat exchanger 13 conducts heat exchange with air passing through. The indoor heat exchanger 13 also has an inverted V shape in which both ends curve downward in a side view, and the indoor fan 14 is positioned underneath. The indoor fan 14, which is a cross flow fan, blows the air taken from within the room back out into the room after causing the air to pass through while in contact with the indoor heat exchanger 13.

A blow-out port 15 is provided in the bottom part of the main body casing 11. The blow-out port 15 is provided with a turnable airflow direction adjustment vane 31 for varying the direction of blown air that is blown out from the blow-out port 15. The airflow direction adjustment vane 31, which is driven by a first motor 70, not only varies the direction of the blown air but can also open and close the blow-out port 15. The airflow direction adjustment vane 31 can assume a plurality of orientations of different incline angles.

A Coandă vane 32 is provided in proximity to the blow-out port 15. The Coandă vane 32 can be made by a second motor 72 to assume an orientation inclined in the forward-backward direction, and when operation has stopped, the vane is accommodated in an accommodation part 130 provided to the front surface panel 11*b*. The Coandă vane 32 can assume a plurality of orientations of different incline angles.

The blow-out port 15 is joined with the interior of the main body casing 11 by a blow-out flow channel 18. The blow-out flow channel 18 is formed from the blow-out port 15 along a scroll 17 of the bottom frame 16.

Indoor air is drawn into the indoor fan 14 via the intake port and the indoor heat exchanger 13 by the working of the indoor fan 14, and is blown out from the indoor fan 14 and then from the blow-out port 15 via the blow-out flow channel 18.

The control unit 40 is positioned to the right of the indoor heat exchanger 13 and the indoor fan 14 when the main body casing 11 is viewed from the front surface panel 11*b*, and the control unit controls rotational speed of the indoor fan 14 and the actuating of the airflow direction adjustment vane 31 and the Coandă vane 32.

(2) Detailed Configuration (2-1) Front Surface Panel 11*b*

The front surface panel 11*b* extends in a slight arcuate curve from the top front of the main body casing 11 toward the front edge of the bottom horizontal plate 11*d*, as shown in FIG. 1. In the bottom part of the front surface panel 11*b* there is an area recessed toward the inside of the main body casing 11. The recessed depth of this area is set so as to match the thickness dimension of the Coandă vane 32, and this area constitutes the accommodation part 130 where the Coandă vane 32 is accommodated. The surface of the accommodation part 130 also has a slight arcuate curve.

(2-2) Blow-Out Port 15

The blow-out port 15, which is formed in the bottom part of the main body casing 11 as shown in FIG. 1, is a rectangular opening the long sides of which run in the horizontal direction (the direction orthogonal to the image plane of FIG. 1). The bottom end of the blow-out port 15 touches the front edge of the bottom horizontal plate 11*d*, and an imaginary plane joining the bottom and top ends of the blow-out port 15 is inclined forward and upward.

(2-3) Scroll 17

The scroll 17 is a dividing wall curved so as to face the indoor fan 14, and is part of the bottom frame 16. The final end F of the scroll 17 reaches the peripheral edge proximity of the blow-out port 15. Air passing through the blow-out flow channel 18 progresses along the scroll 17, and the air is sent tangentially to the final end F of the scroll 17. Therefore, if the blow-out port 15 did not have the airflow direction adjustment vane 31, the airflow direction of air blown out from the blow-out port 15 would flow substantially along a tangent L0 to the final end F of the scroll 17.

(2-4) Vertical Airflow Direction Adjustment Plate 20

A vertical airflow direction adjustment plate 20 has a plurality of vane pieces 201 and a linking rod 203 for linking the plurality of vane pieces 201 as shown in FIGS. 1 and 2. The vertical airflow direction adjustment plate 20 is disposed nearer to the indoor fan 14 than the airflow direction adjustment vane 31 within the blow-out flow channel 18.

The vane pieces 201 swingably move left and right centered about a vertical state relative to the longitudinal direction of the blow-out port 15, due to the horizontal back-and-forth movement of the linking rod 203 along the longitudinal direction of the blow-out port 15. The linking rod 203 is moved horizontally back and forth by a motor (not shown).

(2-5) Airflow Direction Adjustment Vane 31

The airflow direction adjustment vane 31 has a surface area sufficient to close the blow-out port 15. With the airflow direction adjustment vane 31 in a state of closing the blow-out port 15, the outer surface 31*a* thereof is finished to a convex and slightly arcuate curved surface in the outer side so as to be an extension of the curved surface of the front surface panel 11*b*. The inner surface 31*b* (see FIG. 2) of the airflow direction adjustment vane 31 is also an arcuate curved surface substantially parallel to the outer surface.

The airflow direction adjustment vane 31 has a turning shaft 311 at the bottom end. The turning shaft 311, which is in proximity to the bottom end of the blow-out port 15, is linked to a rotating shaft of a stepping motor (not shown) fixed to the main body casing 11.

The turning shaft 311 turns counterclockwise in the front view of FIG. 1, whereby the top end of the airflow direction adjustment vane 31 is actuated so as to draw away from the top end of the blow-out port 15, thus opening the blow-out port 15. Conversely, the turning shaft 311 turns clockwise in the front view of FIG. 1, whereby the top end of the airflow direction adjustment vane 31 is actuated so as to draw near the top end of the blow-out port 15, thus closing the blow-out port 15.

With the airflow direction adjustment vane 31 in a state of leaving the blow-out port 15 open, the air blown out from the blow-out port 15 flows substantially along the inner surface 31*b* of the airflow direction adjustment vane 31. Specifically, the air blown out substantially tangentially to the final end F of the scroll 17 is varied in terms of airflow direction somewhat upward by the airflow direction adjustment vane 31.

(2-6) Coandă Vane 32

The Coandă vane 32 is accommodated in the accommodation part 130 while air-conditioning operation has stopped and during operation in a normal blow-out mode, described hereinafter. The Coandă vane 32 separates from the accommodation part 130 by turning. A turning shaft 321 of the Coandă vane 32 is provided to a position in proximity to the bottom end of the accommodation part 130 and on the inner side of the main body casing 11 (a position above the top wall of the blow-out flow channel 18), and the bottom end of the Coandă vane 32 and the turning shaft 321 are linked with a predetermined gap in between them. Therefore, the more the turning shaft 321 turns and the farther the Coandă vane 32 separates from the accommodation part 130 in the indoor unit front surface, the more the Coandă vane 32 rotates an that the bottom end thereof is positioned at a lower height. The incline when the Coandă vane 32 has rotated open is less than the incline of the indoor unit front surface.

In the present embodiment, the accommodation part 130 is provided outside of a blowing path, and the entire Coandă vane 32 when accommodated is accommodated on the outside of the blowing path. An alternative to this structure is one in which only part of the Coandă vane 32 is accommodated on the outside of the blowing path and the rest is accommodated within the blowing path (in the top wall part of the blowing path, for example).

The turning shaft 321 turns counterclockwise in the front view of FIG. 1, whereby both the top and bottom ends of the Coandă vane 32 separate from the accommodation part 130 while moving in an arc, but at this time, the shortest distance between the top end and the accommodation part 130 in the indoor unit front surface above the blow-out port is greater than the shortest distance between the bottom end and the accommodation part 130. Specifically, the Coandă vane 32 is controlled in an orientation so as to separate from the indoor unit front surface as it goes to the forward side of the vane. The turning shaft 321 then turns clockwise in the front view of FIG. 1, whereby the Coandă vane 32 draws near the accommodation part 130 and is ultimately accommodated in the accommodation part 130. The orientations of the Coandă vane 32 in an operating state include being accommodated in the accommodation part 130, rotating to be inclined forward and upward, further rotating to be substantially horizontal, and further rotating to be inclined forward and downward.

With the Coandă vane 32 accommodated in the accommodation part 130, the outer surface 32*a* of the Coandă vane 32 is finished to a convex and slightly arcuate curved surface in the outer side on as to be an extension of the slightly arcuate curved surface of the front surface panel 11*b*. The inner surface 32*b* of the Coandă vane 32 is finished to an arcuate curved surface so as to run along the surface of the accommodation part 130.

The longitudinal dimension of the Coandă vane 32 is set so as to be equal to or greater than the longitudinal dimension of the airflow direction adjustment vane 31. The reason for this is because all of the blown air whose airflow direction is adjusted by the airflow direction adjustment vane 31 is received by the Coandă vane 32, and the purpose is to prevent the blown air from the sides of the Coandă vane 32 from short circuiting.

(3) Blown Air Direction Control

As means for controlling the direction of blown air, the air-conditioning indoor unit of the present embodiment has a normal blowing mode in which only the airflow direction adjustment vane 31 is turned to adjust the direction of blown air, a Coandă effect use mode in which the airflow direction adjustment vane 31 and the Coandă vane 32 are turned to make the blown air into a Coandă airflow along the outer surface 32*a* of the Coandă vane 32 due to the Coandă effect, and a blow down mode in which the distal ends of both the airflow direction adjustment vane 31 and the Coandă vane 32 are oriented forward and downward to lead the blown air downward.

Because the orientations of the airflow direction adjustment vane 31 and the Coandă vane 32 change with each blown direction of air in the modes described above, the orientations are described with reference to FIGS. 3A to 3E. The blown direction can be selected by the user through a remote control or the like. The mode and blown direction can also be controlled so as to vary automatically.

(3-1) Normal Blowing Mode

The normal blowing mode is a mode in which only the airflow direction adjustment vane 31 is turned to adjust the direction of blown air, and this mode includes "normal forward blowing" and "normal forward-downward blowing."

(3-1-1) Normal Forward Blowing

Figure 3A:
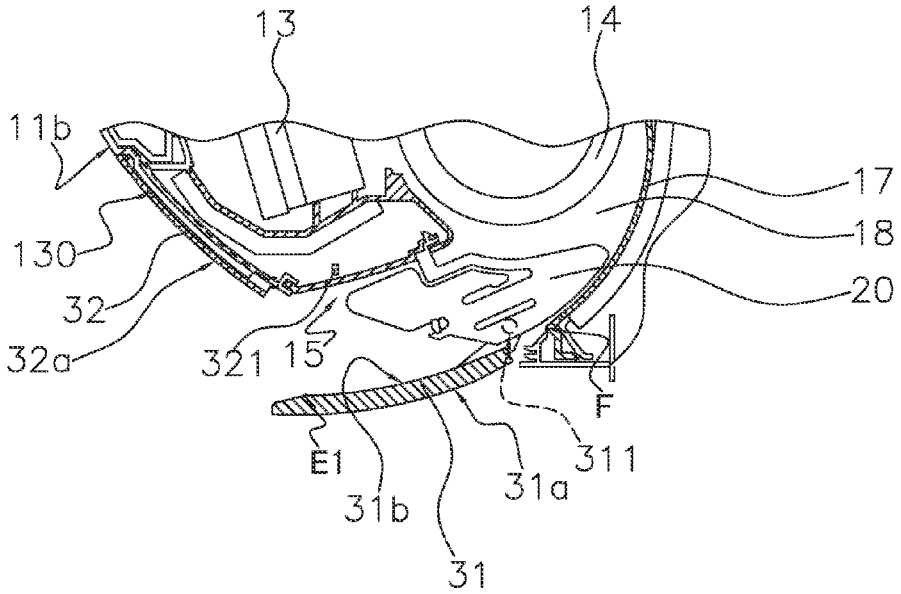
FIG. 3A is a side view of the airflow direction adjustment vane and the Coandă vane during normal forward blowing of blown air.

FIG. 3A is a side view of the airflow direction adjustment vane 31 and the Coandă vane 32 during normal forward blowing of blown air. In FIG. 3A, when the user selects "normal forward blowing," the control unit 40 turns the airflow direction adjustment vane 31 until the inner surface 31*b* of the airflow direction adjustment vane 31 comes to a substantially horizontal position. When the inner surface 31*b* of the airflow direction adjustment vane 31 has an arcuate curved surface as in the present embodiment, the airflow direction adjustment vane 31 is turned until a tangent at the front end E1 of the inner surface 31*b* is substantially horizontal. As a result, the blown air is in a forward blowing state.

(3-1-2) Normal Forward-Downward Blowing

Figure 3B:
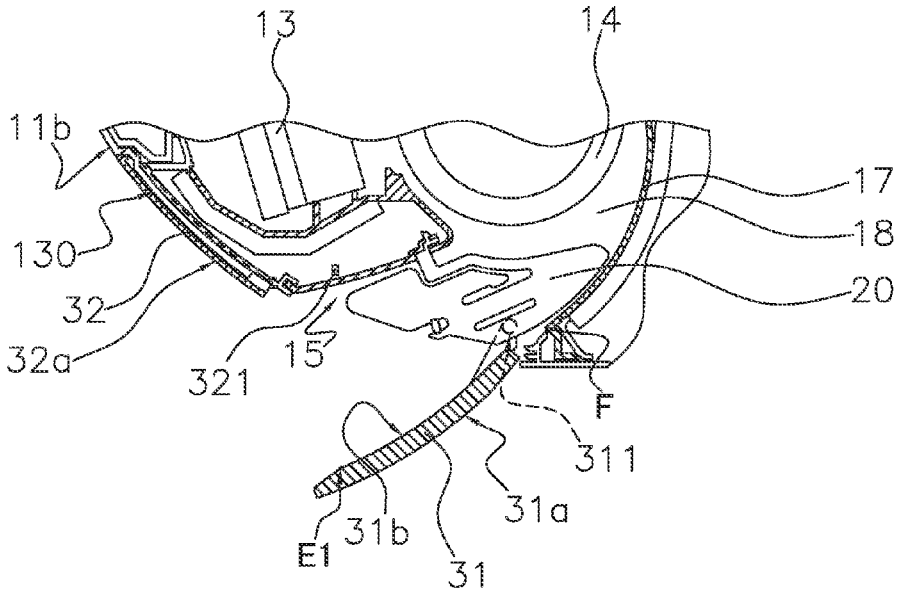
FIG. 3B is a side view of the airflow direction adjustment vane and the Coandă vane during normal forward-downward blowing of blown air.

FIG. 3B is a side view of the airflow direction adjustment vane 31 and the Coandă vane 32 during normal forward-downward blowing of blown air. In FIG. 3B, the user should select "normal forward-downward blowing" when desiring the blown direction to be further down than "normal forward blowing."

At this time, the control unit 40 turns the airflow direction adjustment vane 31 until the tangent at the front end E1 of the inner surface 31*b* of the airflow direction adjustment vane 31 is oriented more forward and downward than horizontal. As a result, the blown air is in a forward-downward blowing state.

(3-2) Coandă Effect Use Mode

The term Coandă (effect) refers to a phenomenon whereby, when there is a wall next to a flow of a gas or liquid, the flow diverts toward a direction along the wall surface even if the flow direction and wall direction are different ("Dictionary of Law" by Asakura Publishing Co., Ltd.). The Coandă effect use mode includes "Coandă airflow forward blowing" and "Coandă airflow ceiling blowing" which use the Coandă effect.

Figure 4A:
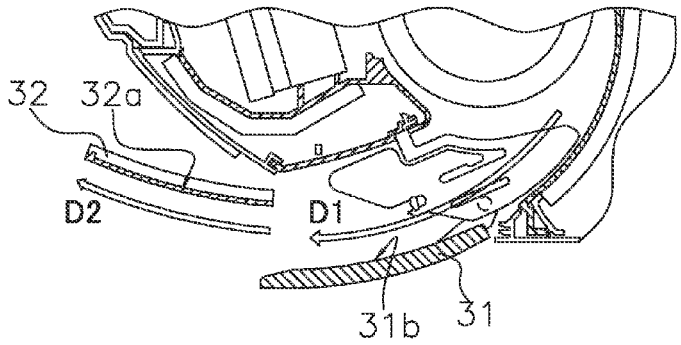
FIG. 4A is a schematic drawing showing the blown air direction and the Coandă airflow direction.

The method for defining the blown air direction and the Coandă airflow direction differs depending on how the reference position is found, and one example is therefore given below. However, the method is not limited to this example. FIG. 4A is a schematic drawing showing the blown air direction and the Coandă airflow direction. In FIG. 4A, to create a Coandă effect on the outer surface 32*a* of the Coandă vane 32, the incline of the blown air direction (D1) varied by the airflow direction adjustment vane 31 must be close to the orientation (incline) of the Coandă vane 32. When the two are too far apart, there is no Coandă effect. Therefore, in the present Coandă effect use mode, the Coandă vane 32 and the airflow direction adjustment vane 31 must have a predetermined opening angle or less, and both adjustment vanes (31, 32) are brought within this range to give rise to the relationship described above. After the airflow direction of the blown air is changed to D1 by the airflow direction adjustment vane 31, it is then changed to D2 by the Coandă effect as shown in FIG. 4A.

In the Coandă effect use mode of the present embodiment, the Coandă vane 32 is preferably in a position in front of (downstream of the blowing) and above the airflow direction adjustment vane 31.

Figure 4B:
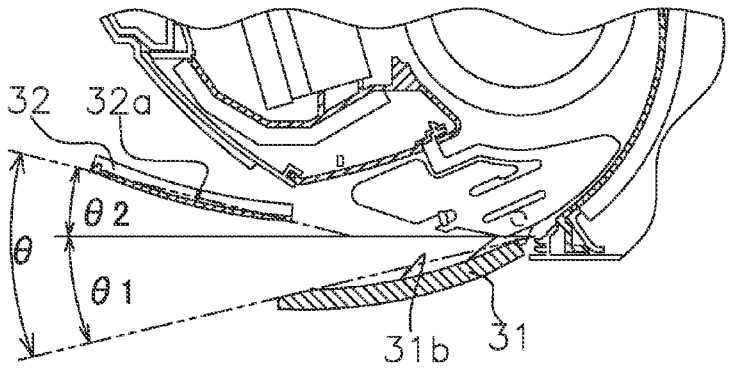
FIG. 4B is a schematic drawing showing an example of the opening angle between the airflow direction adjustment vane and the Coandă vane.

The method for defining the opening angle between the airflow direction adjustment vane 31 and the Coandă vane 32 differs depending on how the reference position is found, and one example is therefore given below. However, the method is not limited to this example. FIG. 4B is a schematic drawing showing an example of the opening angle of the airflow direction adjustment vane 31 and the Coandă vane 32. In FIG. 4B, the opening angle θ between the airflow direction adjustment vane 31 and the Coandă vane 32 is expressed as $\theta=\theta2-\theta1$, wherein the angle between a horizontal line and a straight line joining the front and rear ends of the inner surface 31*b* of the airflow direction adjustment vane 31 is the incline angle θ1 of the airflow direction adjustment vane 31, and the angle between the horizontal line and a straight line joining the front and rear ends of the outer surface 32*a* of the Coandă vane 32 is the incline angle θ2 of the Coandă vane 32. θ1 and θ2 are not absolute values, but are negative values when below the horizontal line in the front view of FIG. 4B.

In both "Coandă airflow forward blowing" and "Coandă airflow ceiling blowing," the airflow direction adjustment vane 31 and the Coandă vane 32 preferably assume orientations in which the inner angle formed by the tangent to the final end F of the scroll 17 and the Coandă vane 32 is greater than the inner angle formed by the tangent to the final end F of the scroll 17 and the airflow direction adjustment vane 31.

Figure 5A:
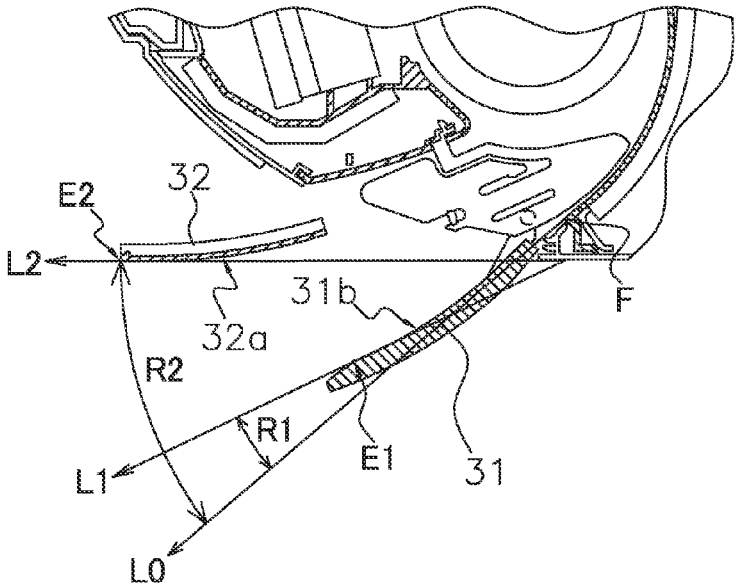
FIG. 5A is a comparative drawing, during Coandă airflow forward blowing, of the inner angle formed by the tangent to the final end F of the scroll and the Coandă vane, and the inner angle formed by the tangent to the final end F of the scroll and the airflow direction adjustment vane.
Figure 5B:
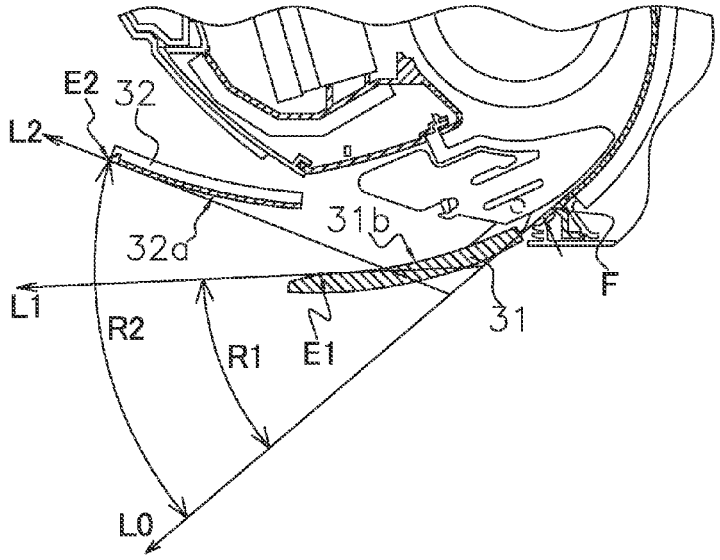
FIG. 5B a comparative drawing, during Coandă airflow ceiling blowing, of the inner angle formed by the tangent to the final end F of the scroll and the Coandă vane, and the inner angle formed by the tangent to the final end F of the scroll and the airflow direction adjustment vane.

For the inner angle, refer to FIG. 5A (a comparative drawing, during Coandă airflow forward blowing, of the inner angle R2 formed by the tangent L0 to the final end F of the scroll 17 and the Coandă vane 32, and the inner angle R1 formed by the tangent L0 to the final end F of the scroll 17 and the airflow direction adjustment vane 31) and FIG. 5B (a comparative drawing, during Coandă airflow ceiling blowing, of the inner angle R2 formed by the tangent L0 to the final end F of the scroll 17 and the Coandă vane 32, and the inner angle R1 formed by the tangent L0 to the final end F of the scroll 17 and the airflow direction adjustment vane 31).

In the Coandă vane 32 during the Coandă effect use mode as shown in FIG. 5B, the distal end of the Coandă vane 32 is forward and upward than being horizontal, and is positioned farther outward and above the blow-out port 15. As a result, the Coandă airflow reaches further, strong airflows that would pass over the top side of the Coandă vane are suppressed, and upward diverting of the Coandă airflow is not likely to be inhibited.

The Coandă airflow is also created easily by the Coandă effect in the upstream side because the rear end of the Coandă vane 32 is at a lower height position than when operation has stopped.

(3-2-1) Coandă Airflow Forward Blowing

Figure 3C:
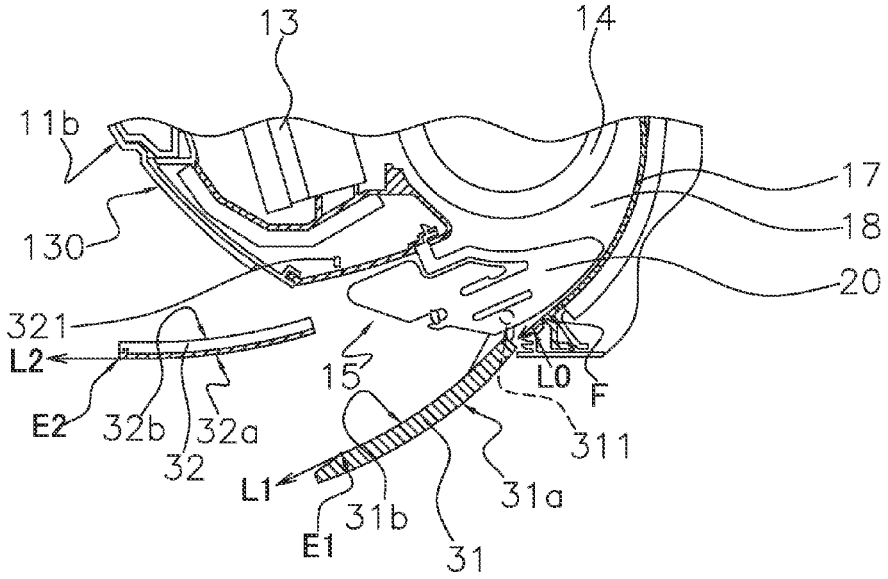
FIG. 3C is a side view of the airflow direction adjustment vane and the Coandă vane during Coandă airflow forward blowing.

FIG. 3C is a side view of the airflow direction adjustment vane 31 and the Coandă vane 32 during Coandă airflow forward blowing. In FIG. 3C, when "Coandă airflow forward blowing" is selected, the control unit 40 turns the airflow direction adjustment vane 31 until the tangent L1 to the front end E1 of the inner surface 31*b* of the airflow direction adjustment vane 31 is forward and lower than being horizontal.

Next, the control unit 40 turns the Coandă vane 32 until the outer surface 32*a* of the Coandă vane 32 reaches a substantially horizontal position. When the outer surface 32*a* of the Coandă vane 32 has an arcuate curved surface as in the present embodiment, the Coandă vane 32 is turned until the tangent L2 to the front end E2 of the outer surface 32*a* is substantially horizontal. In other words, the inner angle R2 formed by the tangent L0 and the tangent L2 is greater than the inner angle R1 formed by the tangent L0 and the tangent L1, as shown in FIG. 5A.

The blown air adjusted to forward-downward blowing by the airflow direction adjustment vane 31 flows adhering to the outer surface 32*a* of the Coandă vane 32 due to the Coandă effect, and changes to a Coandă airflow along the outer surface 32*a*.

Therefore, even if the direction of the tangent L1 to the front end E1 of the airflow direction adjustment vane 31 is at forward-downward blowing, the direction of the tangent L2 to the front end E2 of the Coandă vane 32 is horizontal, and the blown air is therefore blown out in the direction of the tangent L2 to the front end E2 of the outer surface 32*a* of the Coandă vane 32, i.e. in a horizontal direction, due to the Coandă effect.

Thus, the Coandă vane 32 separates from the indoor unit front surface, lessening the incline, and the blown air is readily subjected to the Coandă effect further forward than the front surface panel 11*b*. As a result, even when the blown air whose airflow direction is adjusted by the airflow direction adjustment vane 31 is blown forward and downward, the air is diverted horizontally by the Coandă effect. This means that the airflow direction is varied while pressure loss due to the draft resistance of the airflow direction adjustment vane 31 is suppressed, more so than in a conventional (Patent Literature 1) method in which air immediately after passing through the blow-out port is brought near the front surface panel and directed upward by the Coandă effect of the front surface panel.

(3-2-2) Coandă Airflow Ceiling Blowing

Figure 3D:
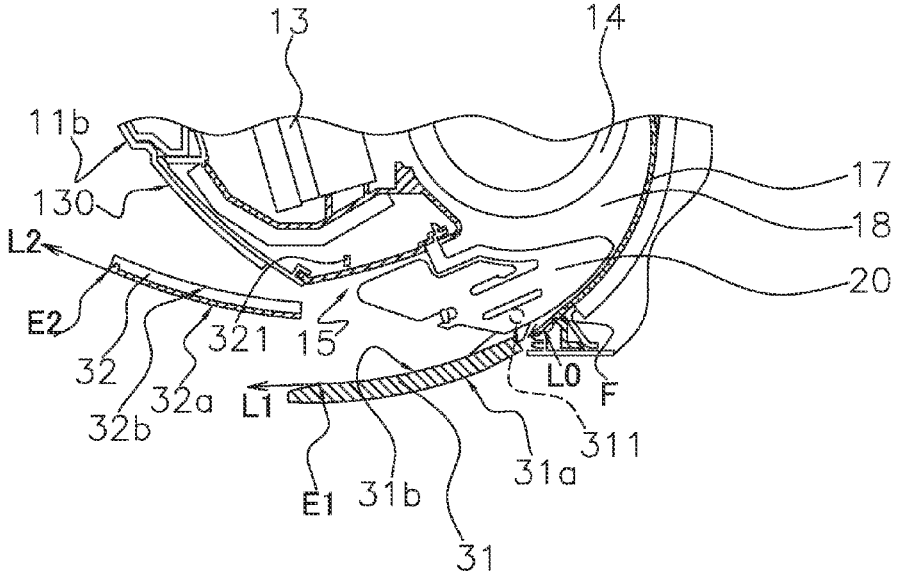
FIG. 3D is a side view of the airflow direction adjustment vane and the Coandă vane during Coandă airflow ceiling blowing.

FIG. 3D is a side view of the airflow direction adjustment vane 31 and the Coandă vane 32 during Coandă airflow ceiling blowing. In FIG. 3D, when "Coandă airflow ceiling blowing" is selected, the control unit 40 turns the airflow direction adjustment vane 31 until the tangent L1 to the front end E1 of the inner surface 31*b* of the airflow direction adjustment vane 31 is horizontal.

Next, the control unit 40 turns the Coandă vane 32 until the tangent L2 to the front end E2 of the outer surface 32*a* is oriented forward and upward. In other words, the inner angle R2 formed by the tangent L0 and the tangent L2 is greater than the inner angle R1 formed by the tangent L0 and the tangent L1, as shown in FIG. 5B. The blown air adjusted to horizontal blowing by the airflow direction adjustment vane 31 flows adhering to the outer surface 32*a* of the Coandă vane 32 due to the Coandă effect, and changes to a Coandă airflow along the outer surface 32*a*.

Therefore, even when the direction of the tangent L1 to the front end E1 of the airflow direction adjustment vane 31 is forward blowing, the blown air is blown out in the direction of the tangent 12 to the front end E2 of the outer surface 32*a* of the Coandă vane 32, i.e. toward the ceiling due to the Coandă effect because the direction of the tangent L2 to the front end E2 of the Coandă vane 32 is forward-upward blowing. The Coandă airflow reaches farther because the distal end of the Coandă vane 32 protrudes farther outward than the blow-out port 15. Furthermore, because the distal end of the Coandă vane 32 is positioned higher than the blow-out port 15, airflows that would pass over the top side of the Coandă vane are suppressed, and upward diverting of the Coandă airflow is therefore not likely to be inhibited.

Thus, the Coandă vane 32 separates from the indoor unit front surface, lessening the incline, and the blown air is readily subjected to the Coandă effect farther forward than the front surface panel 11*b*. As a result, even when the blown air whose airflow direction is adjusted by the airflow direction adjustment vane 31 is blown forward, the air is diverted upward by the Coandă effect. This means that the airflow direction is varied while pressure loss due to the draft resistance of the airflow direction adjustment vane 31 is suppressed, more so than in a conventional (Patent Literature 1) method in which air immediately after passing through the blow-out port is brought near the front surface panel and directed upward by the Coandă effect of the front surface panel.

As a result, the blown air is diverted toward the ceiling while the blow-out port 15 remains seemingly open, more so than in the invention disclosed in Patent Literature 1 in which an airflow is created along the front surface panel. In other words, the blown air is diverted toward the ceiling while the draft resistance is kept low.

The dimension of the Coandă vane 32 in the longitudinal direction is equal to or greater than the dimension of the airflow direction adjustment vane. 31 in the longitudinal direction. Therefore, all of the blown air whose airflow direction is adjusted by the airflow direction adjustment vane 31 can be received by the Coandă vane 32, and the effect of preventing blown air from the sides of the Coandă vane 32 from short circuiting is also achieved.

(3-3) Downward Blowing Mode

Figure 3E:
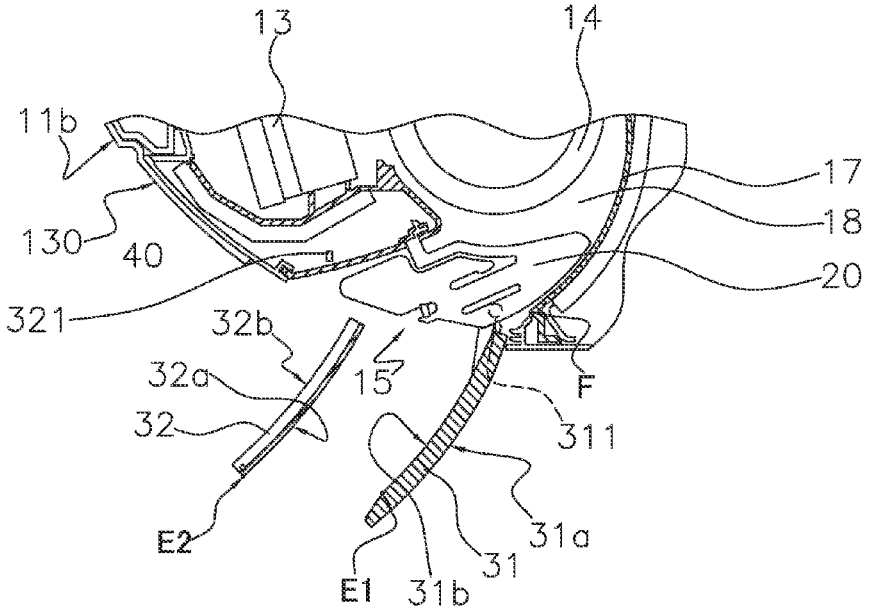
FIG. 3E is a side view of the airflow direction adjustment vane and the Coandă vane during downward blowing.

FIG. 3E is a side view of the airflow direction adjustment vane 31 and the Coandă vane 32 during downward blowing. In FIG. 3E, when "downward blowing" is selected, the control unit 40 turns the airflow direction adjustment vane 31 until the tangent to the front end E1 of the inner surface 31*b* of the airflow direction adjustment vane 31 is oriented downward.

Next, the control unit 40 turns the Coandă vane 32 until the tangent to the front end E2 of the outer surface 32*a* is oriented downward. As a result, the blown air is passed between the airflow direction adjustment vane 31 and the Coandă vane 32 and blown downward.

Particularly, even when the airflow direction adjustment vane 31 is oriented further downward than the tangent angle to the final end of the scroll 12, the control unit 40 can create a downward airflow against the outer surface 32*a* of the Coandă vane 32 by implementing the downward blowing mode.

(4) Actuation

The actuation of the air-conditioning indoor unit, which uses the blown air direction control described above, is described below with reference to the drawings.

(4-1) Coandă Airflow Direction Setting (4-1-1) First Orientation of Coandă Vane 32

Figure 6A:
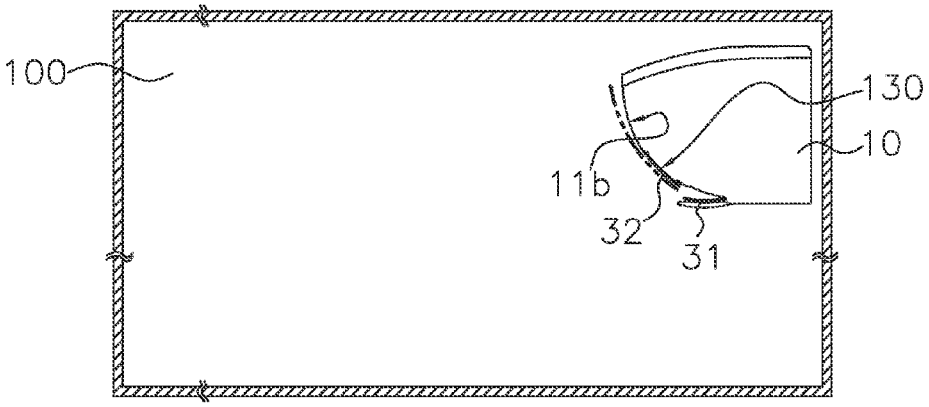
FIG. 6A is a side view of installation space of the air-conditioning indoor unit, showing the airflow direction of the Coandă airflow when the Coandă vane assumes a first orientation.

FIG. 6A is a side view of an installation space of the air-conditioning indoor unit, showing the airflow direction of the Coandă airflow when the Coandă vane 32 assumes a first orientation. In FIG. 6A, the air-conditioning indoor unit 10 is installed at the top of an indoor side wall. The Coandă vane 32 is in a state of being accommodated in the accommodation part 130 (referred to hereinafter as the first orientation). Due to the orientation of the airflow direction adjustment vane 31 being more upward than horizontal when the Coandă vane 32 is in the first orientation, the blown air whose airflow direction is adjusted by the inner surface 31*b* of the airflow direction adjustment vane 31 separates from the inner surface 31*b*, after which the direction of the air changes so as to be pulled to the outer surface 32*a* of the Coandă vane 32, and the air forms a first Coandă airflow and flows along the front surface panel 11*b* and the outer surface 32*a* of the Coandă vane 32.

Figure 7A:
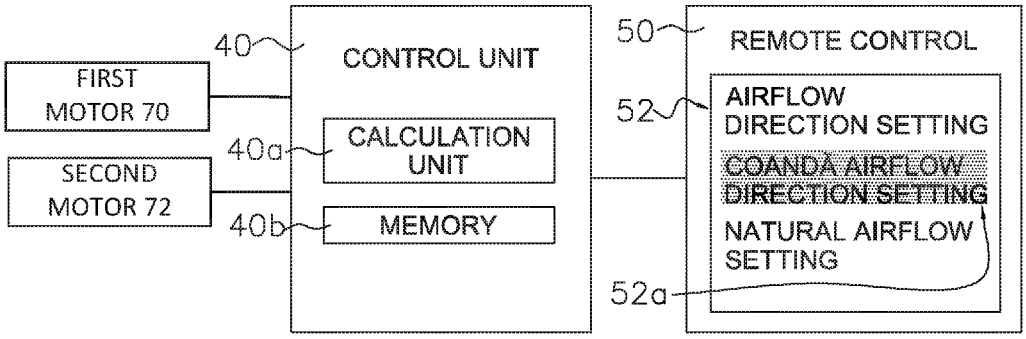
FIG. 7A is a block diagram showing the relationship between the control unit and a remote control.

Herein is a description of the method whereby the user selects the Coandă airflow. FIG. 7A is a block diagram showing the relationship between the control unit 40 and a remote control 50. In FIG. 7A, the remote control 50 transmits infrared signals wirelessly. The remote control 50 has switching means for switching the airflow direction. Specifically, the remote control has a display unit 52 for displaying airflow direction selection menus and a cursor 52*a* for indicating each of the airflow direction selection menus, so that the user can select the airflow direction.

First, the user uses the cursor 52*a* to select "Coandă airflow direction setting" from the menus displayed on the display unit 52. A detailed description is omitted because the techniques for selecting and confirming a menu through the remote control 50 are widespread public knowledge.

Figure 7B:
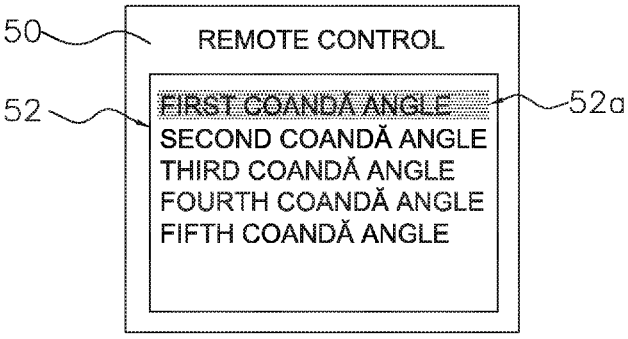
FIG. 7B is a front view of the display unit showing a sub-menu of the "Coandă airflow direction setting" menu.

FIG. 7B is a front view of the display unit 52 showing a sub-menu of the "Coandă airflow direction setting" menu. In FIG. 7B, first through fifth Coandă angles are prepared in advance on the sub-menu of the "Coandă airflow direction setting" menu and the first Coandă angle is indicated and confirmed by the cursor 52*a*, whereby the Coandă vane 32 assumes the first orientation shown in FIG. 6A, creating a Coandă airflow in a first direction corresponding to the first Coandă angle.

(4-1-2) Second Orientation and Third Orientation of Coandă Vane 32

Figure 6B:
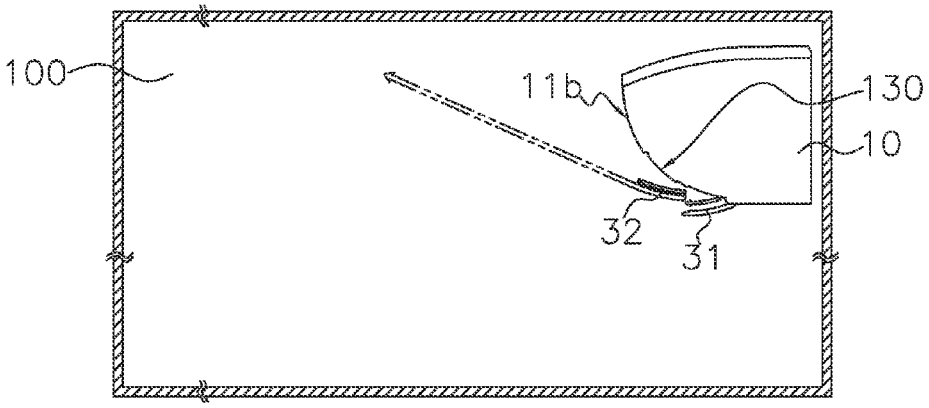
FIG. 6B is a side view of installation space of the air-conditioning indoor unit, showing the airflow direction of the Coandă airflow when the Coandă vane assumes a second orientation.

Next, FIG. 6B is a side view of the installation space of the air-conditioning indoor unit, showing the airflow direction of the Coandă airflow when the Coandă vane 32 assumes the second orientation. The second orientation of the Coandă vane 32 in FIG. 69 is implemented by indicating and confirming the second Coandă angle with the cursor 52*a* in FIG. 79. The Coandă airflow created when the Coandă vane 32 is in the second orientation is equivalent to the Coandă airflow described in the stage "(3-2-2) Coandă airflow ceiling blowing." When the second Coandă angle is selected, the control unit 40 turns the airflow direction adjustment vane 31 until the tangent L1 to the front end E1 of the inner surface 31*b* of the airflow direction adjustment vane 31 is horizontal, and then turns the Coandă vane 32 until the tangent L2 to the front end E2 of the outer surface 32*a* is oriented forward and upward, as shown in FIG. 3D. Therefore, even when the direction of the tangent L1 to the front end E1 of the airflow direction adjustment vane 31 is forward blowing, the blown air is blown out in the direction of the tangent L2 at the front end E2 of the outer surface 32*a* of the Coandă vane 32, i.e. toward the ceiling due to the Coandă effect, because the direction of the tangent L2 at the front end E2 of the Coandă vane 32 is forward-upward blowing.

Figure 8A:
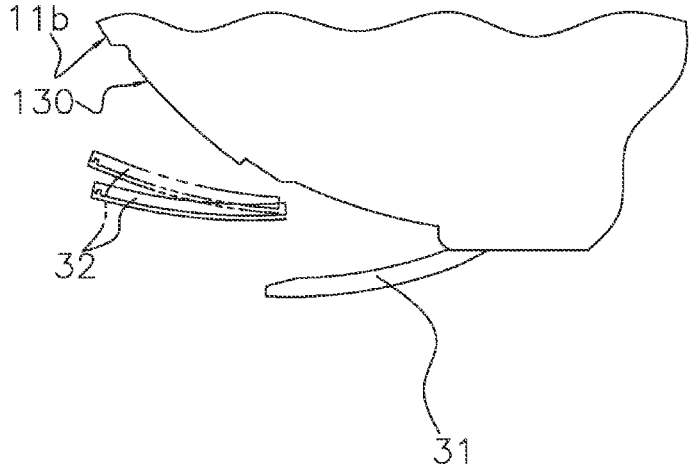
FIG. 8A is a side view of the airflow direction adjustment vane and the Coandă vane when the Coandă vane is in the third orientation.

Once a Coandă airflow has been created, the direction of the Coandă airflow can be adjusted by varying only the angle of the Coandă vane 32, without moving the airflow direction adjustment vane 31. For example, FIG. 8A is a side view of the airflow direction adjustment vane 31 and the Coandă vane 32 when the Coandă vane 32 is in the third orientation. In FIG. 8A, the third orientation of the Coandă vane 32 is further downward than the second orientation. For the sake of comparison in FIG. 8A, the Coandă vane 32 in the second orientation is shown by double-dashed lines, and the Coandă vane 32 in the third orientation is shown by solid lines.

Assuming a Coandă airflow is reliably created with the second orientation and the orientation of the airflow direction adjustment vane 31 does not change, it is clear that the Coandă airflow in the third orientation, which is further downward than the second orientation, does not break away from the outer surface 32*a* of the Coandă vane 32. Thus, when Coandă airflow ceiling blowing is to be implemented, it is achieved by selecting either the second Coandă angle or the third Coandă angle with the cursor 52*a* in FIG. 7B.

In the present embodiment, it is assumed that the second orientation and the third orientation of the Coandă vane 32 are selected when the intention is to send conditioned air far. For example, when there is both a great height distance from the blow-out port 15 to the ceiling and a great opposing distance from the blow-out port 15 to the opposite wall, the orientation of the Coandă vane 32 is preferably the second orientation. On the other hand, in cases such as when there is a small height distance from the blow-out port 15 to the ceiling and a great opposing distance from the blow-out port 15 to the opposite wall, the orientation of the Coandă vane 32 is preferably the third orientation. Thus, the user can select the orientation of the Coandă vane 32 via the remote control 50 in accordance with the size of the indoor space, and conditioned air can therefore be spread evenly throughout the air conditioning target space in addition to the orientations being highly practical.

(4-1-3) Fourth Orientation and Fifth Orientation of the Coandă Vane 32

Figure 6C:
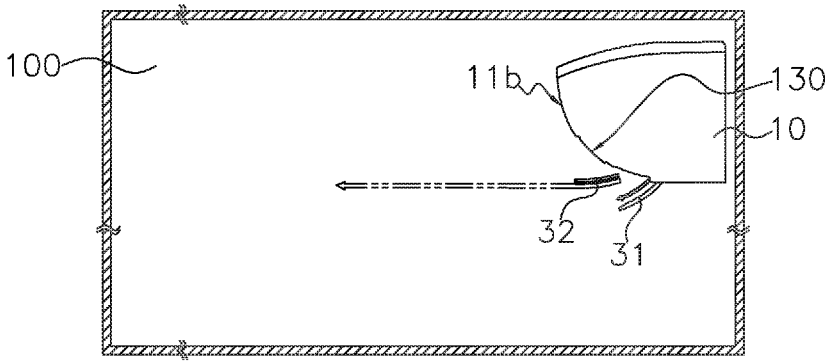
FIG. 6C is a side view of installation space of the air-conditioning indoor unit, showing the airflow direction of the Coandă airflow when the Coandă vane assumes a fourth orientation.

FIG. 6C is a side view of the installation space of the air-conditioning indoor unit, showing the direction of the Coandă airflow when the Coandă vane 32 assumes the fourth orientation. The fourth orientation of the Coandă vane 32 in FIG. 6C can be implemented by indicating and confirming the fourth Coandă angle with the cursor 52*a* in FIG. 7B. The Coandă airflow created when the Coandă vane 32 is in the fourth orientation is equivalent to the Coandă airflow described in the stage "(3-2-1) Coandă airflow forward blowing." When the fourth Coandă angle is selected, the control unit 40 turns the airflow direction adjustment vane 31 until the tangent L1 to the front end E1 of the inner surface 31*b* of the airflow direction adjustment vane 31 is more forward and downward than horizontal, and then turns the Coandă vane 32 until the outer surface 32*a* of the Coandă vane 32 is substantially horizontal, as shown in FIG. 3C. Therefore, even when the direction of the tangent L1 to the front end E1 of the airflow direction adjustment vane 31 is forward-downward blowing, the blown air is blown out in the direction of the tangent L2 to the front end E2 of the outer surface 32*a* of the Coandă vane 32, i.e. horizontally due to the Coandă effect, because the direction of the tangent L2 to the front end E2 of the Coandă vane 32 is horizontal.

Figure 8B:
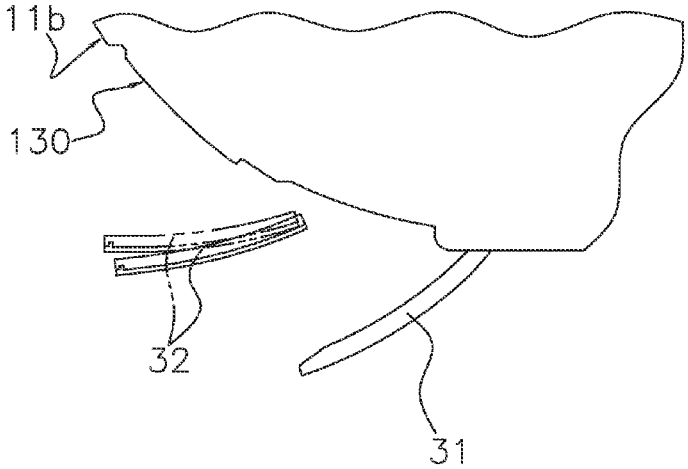
FIG. 8B is a side view of the airflow direction adjustment vane and the Coandă vane when the Coandă vane is in the fifth orientation.

Once a Coandă airflow has been created, the direction of the Coandă airflow can be adjusted by varying only the angle of the Coandă vane 32, without moving the airflow direction adjustment vane 31. For example, FIG. 8B is a side view of the airflow direction adjustment vane 31 and the Coandă vane 32 when the Coandă vane 32 is in the fifth orientation. In FIG. 8B, the fifth orientation of the Coandă vane 32 is further downward than the fourth orientation. For the sake of comparison in FIG. 8B, the Coandă vane 32 in the fourth orientation is shown by double-dashed lines, and the Coandă vane 32 in the fifth orientation is shown by solid lines.

Assuming a Coandă airflow is reliably created with the fourth orientation and the orientation of the airflow direction adjustment vane 31 does not change, it is clear that the Coandă airflow in the fifth orientation, which is further downward than the fourth orientation, does not break away from the outer surface 32*a* of the Coandă vane 32. Thus, when Coandă airflow forward blowing is to be implemented, it is achieved by selecting either the fourth Coandă angle or the fifth Coandă angle with the cursor 52*a* in FIG. 7B.

As is clear from the description above, the orientation of the airflow direction adjustment vane 31 varies with the first orientation, the second orientation, and the fourth orientation of the Coandă vane 32. In other words, the Coandă airflow created by the Coandă vane 32 can be directed in any direction by the combination of the orientation of the airflow direction adjustment vane 31 and the orientation of the Coandă vane 32.

(4-2) Airflow Direction Automatic Switching Action

Figure 9A:
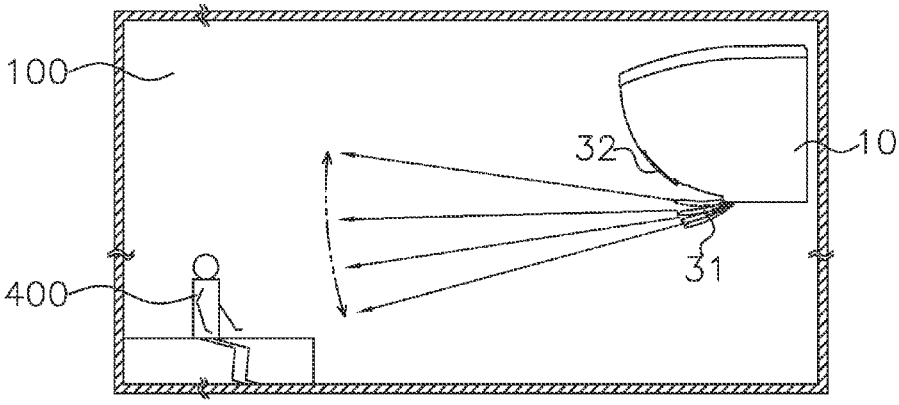
FIG. 9A is a side view of installation space of the air-conditioning indoor unit, showing the airflow direction of the blown air due to the up and down swaying of the airflow direction adjustment vane.
Figure 9B:
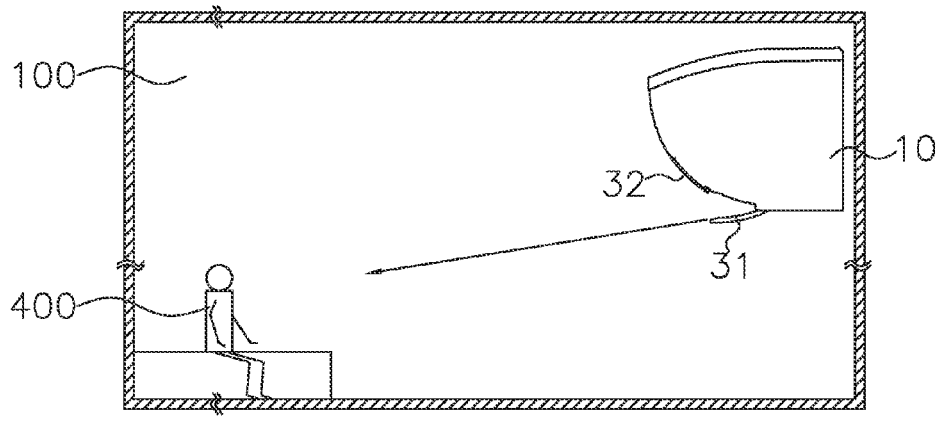
FIG. 9B is a side view of installation space of the air-conditioning indoor unit, showing the airflow direction of the blown air when the airflow direction adjustment vane is oriented downward.

FIG. 9A is a side view of installation space of the air-conditioning indoor unit, showing the airflow direction of the blown air due to the up and down swaying of the airflow direction adjustment vane 31. FIG. 9B is a side view of installation space of the air-conditioning indoor unit, showing the airflow direction of the blown air when the airflow direction adjustment vane 31 is oriented downward. Furthermore, FIG. 9C is aside view of installation space of the air-conditioning indoor unit, showing the airflow direction of the Coandă airflow when the orientation of the Coandă vane 32 is the second orientation.

First, the airflow direction adjustment in FIG. 9A is an airflow direction adjustment performed using a so-called auto-louver function, which is performed in conventional equipment as welt, and is used as means for repeating an action of causing the airflow to contact a person 400 and an action of causing the airflow to not contact the person. However, this manner of airflow contact is such that the airflow gradually moves near to and gradually away from the person 400, and is therefore not the natural way of airflow suddenly contacting a person.

Figure 9C:
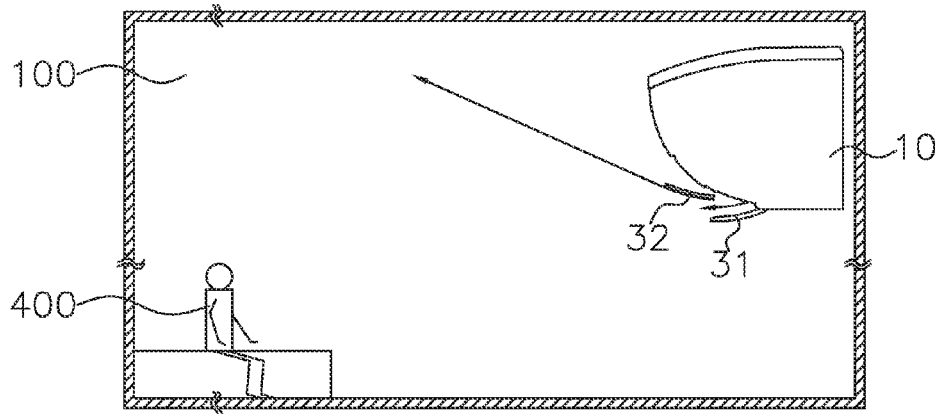
FIG. 9C is a side view of installation space of the air-conditioning indoor unit, showing the airflow direction of the Coandă airflow when the orientation of the Coandă vane is the second orientation.
Figure 10A:
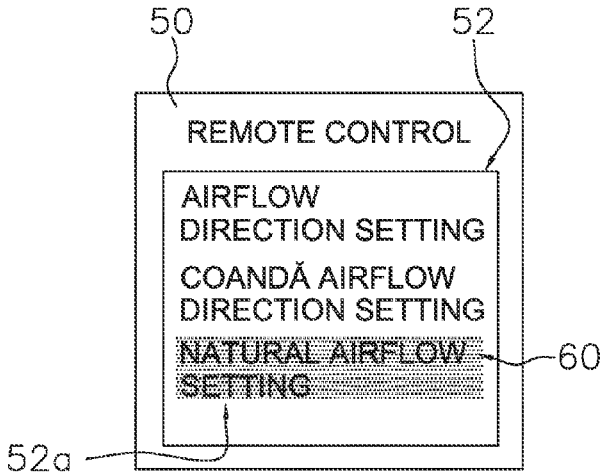
FIG. 10A is a front view of the display unit displaying the airflow direction selection menus.

A more natural airflow of contacting the person suddenly can be created by changing an airflow directed at a person 400 as shown in FIG. 9B to an upward Coandă airflow as shown in FIG. 9C using the Coandă effect, and then performing the opposite action. The method whereby the user selects the natural airflow is described herein. FIG. 10A is a front view of a display unit 52 displaying an airflow direction selection menus. In FIG. 10A, first, the user selects a "natural airflow setting" menu 60 with a cursor 52*a* from among the menus displayed on the display unit 52.

Figure 10B:
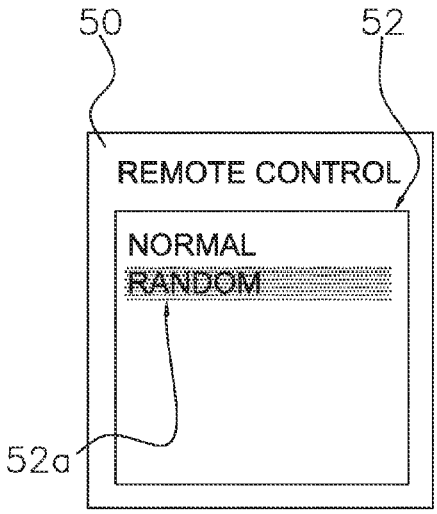
FIG. 10B is a front view of the display unit showing a sub-menu of the "natural airflow setting" menu.

FIG. 10B is a front view of the display unit 52 showing a sub-menu of the "natural airflow setting" menu 60. In FIG. 10B, the modes "normal" and "random" are prepared in advance in the sub-menu of the "natural airflow setting" menu 60.

For example, the user indicates and confirms "random" with the cursor 52*a*, whereby the airflow direction adjustment vane 31 is fixed in a slightly downward orientation and the Coandă vane 32 moves in irregular cycles so as to span the boundary between the area where a Coandă effect is created and the area where a Coandă effect is not created. A Coandă airflow is thereby repeatedly created and dispelled, and an airflow that suddenly contacts the person 400 is produced.

(4-2-1) Action by Coandă Vane 32 Alone

Figure 11A:
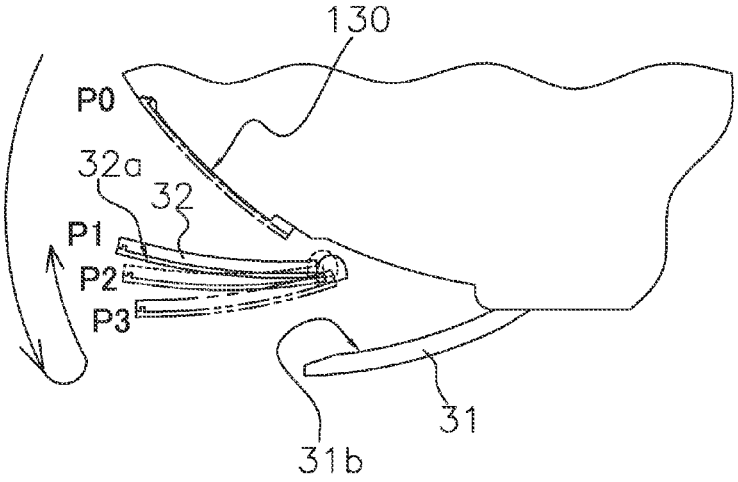
FIG. 11A is a side view of the Coandă vane moving so as to span the boundary between the area where a Coandă effect is created and the area where a Coandă effect is not created.

FIG. 11A is a side view of the Coandă vane 32 moving so as to span the boundary between the area where a Coandă effect is created and the area where a Coandă effect is not created. In FIG. 11A, the airflow direction adjustment vane 31 has a downward orientation. At this time, if the Coandă vane is in the P0 position (accommodated in the accommodating part 130) which is the first orientation, blown air passing through the blow-out port 15 is blown out along the inner surface 31*b* of the airflow direction adjustment vane 31.

The Coandă vane 32 then lowers past the P1 position and the P2 position to the P3 position, and then returns to the P1 position. The blown air is thereby drawn toward the outer surface 32*a* of the Coandă vane 32, becoming a Coandă airflow that flows along the outer surface 32*a*. Assuming the P1 position is a position where the Coandă vane 32 is in the second orientation, the Coandă airflow is directed to the ceiling and therefore does not contact the person 400. At this time, the user feels a sensation that the airflow that had so far been contacting the user has suddenly ceased.

In the case described above, the P0 position is not an area that creates the Coandă effect, but the P1 position and the P2 position that the Coandă vane 32 passes through are included within the Coandă-creating area that reliably creates the Coandă effect, and the Coandă vane 32 without fail spans the boundary between the Coandă non-creating area and the Coandă-creating area.

If the Coandă vane 32 returns to the P0 position which is the first orientation after the passage of an arbitrary time duration, the Coandă effect is instantly dispelled, and the blown air switches to an airflow along the inner surface 31*b* of the airflow direction adjustment vane 31. At this time, the user feels a sensation that the airflow is suddenly contacting him.

By irregularly repeating the actions described above, a sudden and more natural airflow can be made to contact the person 400. Further, by repeating the actions described above with each passage of a fixed time duration, a regular natural airflow can be made to contact the person 400.

(4-2-2) Action by Airflow Direction Adjustment Vane 31 Alone

Figure 11B:
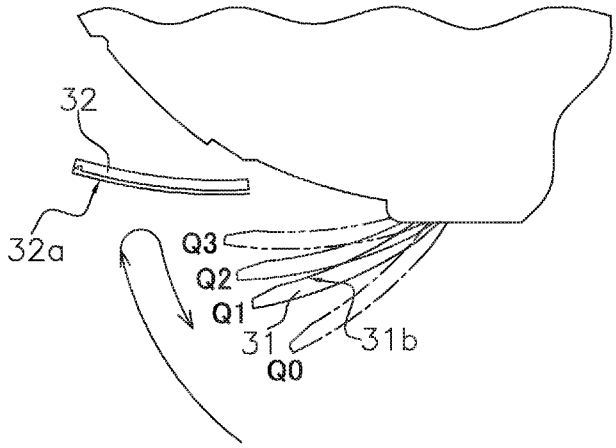
FIG. 11B is a side view of the airflow direction adjustment vane moving so as to span the boundary between the area where a Coandă effect is created and the area where a Coandă effect is not created.

FIG. 11B is a side view of the airflow direction adjustment vane 31 moving so as to span the boundary between the area where a Coandă effect is created and the area where a Coandă effect is not created. In FIG. 11B, the airflow direction adjustment vane 31 is in the Q1 position which is a downward orientation. At this time, the Coandă vane 32 is fixed in the second orientation, and the blown air, which becomes a Coandă airflow along the outer surface 32*a* of the Coandă vane 32, is blown out toward the ceiling.

The airflow direction adjustment vane 31 then lowers to the Q0 position, whereby the Coandă airflow breaks away from the outer surface 32*a* of the Coandă vane 32, the blown air instantly switches to an airflow along the inner surface 31*b* of the airflow direction adjustment vane 31, and the air contacts the person 400. At this time, the user feels a sensation that the airflow is suddenly contacting him.

After the passage of an arbitrary time duration, the airflow direction adjustment vane 31 rises from the Q0 position past the Q1 position and the Q2 position to the Q3 position, and then returns to the Q1 position. At this time, the blown air is instantly drawn toward the outer surface 32*a* of the Coandă vane 32, becoming a Coandă airflow that flows along the outer surface 32*a*. The Coandă vane 32 is in the second orientation, and the Coandă airflow is oriented toward the ceiling and therefore does not contact the person 400. At this time, the user feels a sensation that the airflow that had so far been contacting the user has suddenly ceased.

In the case described above, the Q0 position is not an area that creates the Coandă effect, but the Q1 position and the Q2 position that the airflow direction adjustment vane 31 passes through are included within the Coandă-creating area that reliably creates the Coandă effect, and the airflow direction adjustment vane 31 without fail spans the boundary between the Coandă non-creating area and the Coandă-creating area.

By irregularly repeating the actions described above, a sudden and more natural airflow can be made to contact the person 400. Further, by repeating the actions described above with each passage of a fixed time duration, a regular natural airflow can be made to contact the person 400.

In addition to action by the Coandă vane 32 alone and action by the airflow direction adjustment vane 31 alone, the natural airflow described above can also be produced by actuating both the airflow direction adjustment vane 31 and the Coandă vane 32.

(5) Characteristics (5-1)

In the air-conditioning indoor unit 10, the control unit 40 can execute an airflow direction automatic switching mode. The airflow direction automatic switching mode is a mode of automatically switching between a Coandă effect use state in which the blown air is turned into a Coandă airflow along a predetermined surface and diverted in a predetermined direction, and a normal state in which a Coandă airflow is not created. Therefore, the airflow direction can be changed instantly in the air-conditioning indoor unit 10.

(5-2)

In the air-conditioning indoor unit 10, the Coandă vane 32, which is provided in proximity to the blow-out port 15, turns the blown air into a Coandă airflow along the bottom surface thereof. In the airflow direction automatic switching mode, the control unit 40 controls the orientation of the Coandă vane 32 to switch between the Coandă effect use state and the normal state. The control unit 40 can also control the orientation of the airflow direction adjustment vane 31 to switch between the Coandă effect use state and the normal state in the airflow direction automatic switching mode. Furthermore, the control unit 40 can control the orientations of both the airflow direction adjustment vane 31 and the Coandă vane 32 to switch between the Coandă effect use state and the normal state in the airflow direction automatic switching mode. Therefore, the air-conditioning indoor unit 10 can switch downward blown air instantly to a horizontally blown Coandă airflow, or horizontally blown air instantly to an upward-blown Coandă airflow.

(5-3)

In the air-conditioning indoor unit 10, the control unit 40 can stop the action of the airflow direction adjustment vane 31 and change the orientation of the Coandă vane 32 in the airflow direction automatic switching mode so that the Coandă vane 32 spans the boundary between the area where a Coandă effect is created and the area where a Coandă effect is not created. The control unit 40 can also stop the action of the Coandă vane 32 and change the orientation of the airflow direction adjustment vane 31 in the airflow direction automatic switching mode so that the airflow direction adjustment vane 31 spans the boundary between the area where a Coandă effect is created and the area where a Coandă effect is not created. Furthermore, the control unit 40 can change the orientations of both the airflow direction adjustment vane 31 and the Coandă vane 32 in the airflow direction automatic switching mode so that the airflow direction adjustment vane 31 and the Coandă vane 32 span the boundary between the area where a Coandă effect is created and the area where a Coandă effect is not created.

(5-4)

In the air-conditioning indoor unit 10, the control unit 40 can irregularly switch between the Coandă effect use state and the normal state in the airflow direction automatic switching mode. Therefore, a more natural irregular airflow can be created. The control unit 40 can also regularly switch between the Coandă effect use state and the normal state in the airflow direction automatic switching mode. Therefore, a more natural sudden airflow can be regularly created.

(6) Modifications (6-1) First Modification

The airflow direction automatic switching action of the above embodiment is initiated by selecting the natural airflow setting via the remote control 50, and this action is repeated as long as it is not canceled by the user with the remote control 50. Therefore, it is preferable to have a function whereby the airflow direction automatic switching action is canceled when the user leaves the room.

Figure 12:
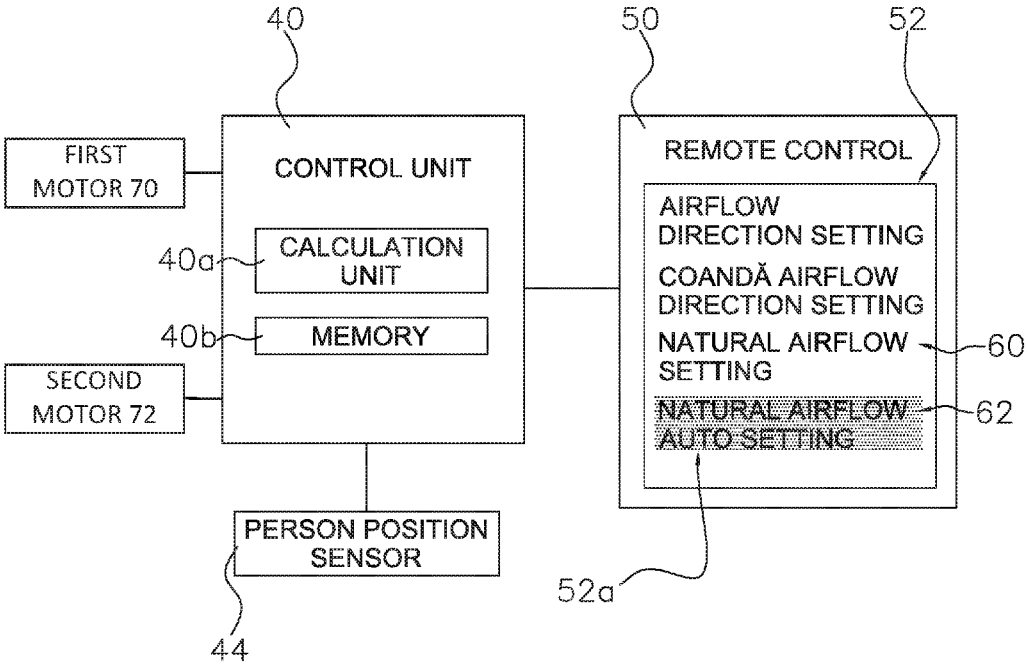
FIG. 12 is a block diagram showing the relationship between the control unit, the person detection sensor, and the remote control.

FIG. 12 is a block diagram showing the relationship between the control unit 40, a person detection sensor 44, and the remote control 50. In FIG. 12, the user can use the cursor 52*a* to select a "natural airflow auto setting" menu 62 from among the menus displayed on the display unit 52. After the user has confirmed the "natural airflow auto setting" menu 62, if the person detection sensor 44 detects that a person is in the room, the control unit 40 adjusts the orientation of the airflow direction adjustment vane 31 so that the blown air is directed toward the person's position, and the control unit puts the Coandă vane 32 in the first orientation (accommodated in the accommodating part 130). This form is similar to the form shown in FIG. 11A and is therefore described below using FIG. 11A.

The Coandă vane 32 then lowers past the P1 position and the P2 position to the P3 position, and returns to the P1 position. The blown air is thereby drawn towards the outer surface 32*a* of the Coandă vane 32, and becomes a Coandă airflow flowing along the outer surface 32*a*. Assuming the P1 position is the position where the Coandă vane 32 is in the second orientation, the Coandă airflow is oriented toward the ceiling and therefore does not contact the person 400. At this time, the user feels a sensation that the airflow that had so far been contacting the user has suddenly ceased.

If the Coandă vane 32 returns to the P0 position which is the first orientation after the passage of an arbitrary time duration, the Coandă effect is instantly dispelled, and the blown air switches to an airflow along the inner surface 31*b* of the airflow direction adjustment vane 31. At this time, the user feels a sensation that the airflow is suddenly contacting him.

By irregularly repeating the actions described above, a sudden and more natural airflow can be made to contact the person 400.

(6-2) Second Modification

Figure 13A:
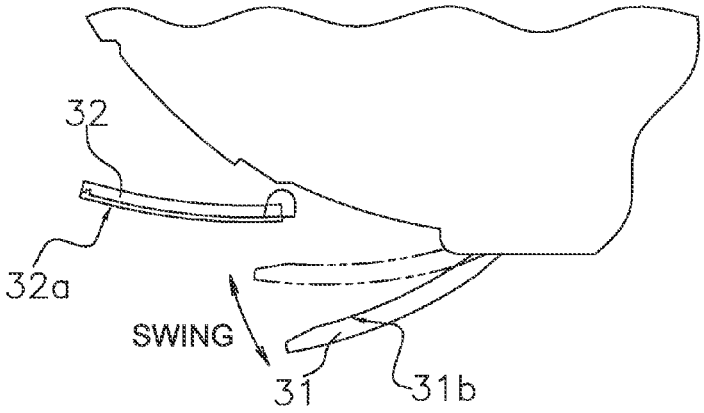
FIG. 13A is a side view of the airflow direction adjustment vane and the Coandă vane of an air-conditioning indoor unit according to a second modification.

FIG. 13A is a side view of the airflow direction adjustment vane 31 and the Coandă vane 32 of an air-conditioning indoor unit according to a second modification. In FIG. 13A, the Coandă vane 32 is stationary with the distal end oriented somewhat above horizontal. The airflow direction adjustment vane 31 swings between an upper position of the distal end oriented somewhat upward from the horizontal direction, and a lower position of the distal end oriented at a downward incline.

The swinging of the airflow direction adjustment vane 31 causes the direction of the blown air to vary vertically, and an occupant of the room therefore feels that the airflow gradually comes closer and gradually goes further away. By coming in contact with the stationary Coandă vane 32, the blown air becomes a Coandă airflow and heads in a direction that does not contact the occupant of the room, and the occupant therefore feels that the airflow has suddenly stopped. Furthermore, when the blown air separates from the stationary Coandă vane 32, the Coandă airflow is dispelled and the occupant feels that an airflow has started to be blown unexpectedly.

Figure 13B:
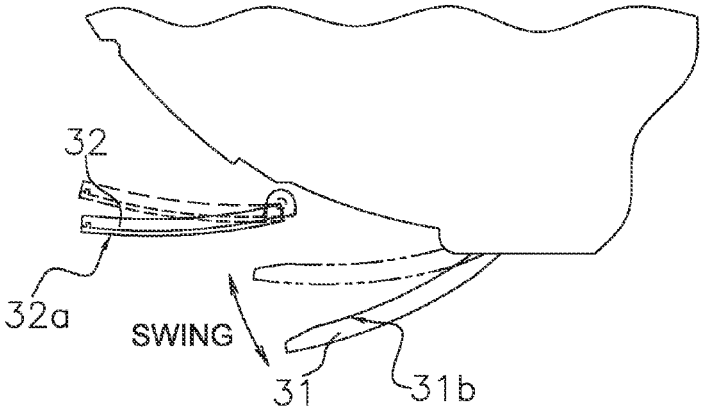
FIG. 13B is a side view of the airflow direction adjustment vane and the Coandă vane when the stationary position of the Coandă vane in FIG. 13A has been shifted slightly downward.

FIG. 13B is a side view of the airflow direction adjustment vane 31 and the Coandă vane 32 when the stationary position of the Coandă vane 32 in FIG. 13A has been shifted slightly downward. In FIG. 13B, every time the number of swings made by the airflow direction adjustment vane 31 reaches a predetermined number, the Coandă vane 32 moves from the current stationary position to a different stationary position. As a result, the timing at which the blown air comes in contact with the Coandă vane 32 and becomes a Coandă airflow is different from the previous instance, the timing at which the airflow contacts the occupant is therefore irregular, and this feeling of irregularity brings the airflow more closer to a natural airflow.

(6-3) Third Modification

Figure 14A:
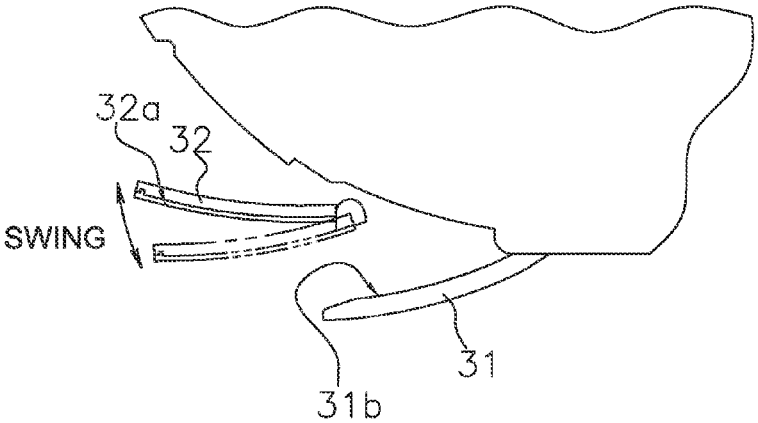
FIG. 14A is a side view of the airflow direction adjustment vane and the Coandă vane of an air-conditioning indoor unit according to a third modification.

FIG. 14A is a side view of the airflow direction adjustment vane 31 and the Coandă vane 32 of an air-conditioning indoor unit according to a third modification. In FIG. 14A, the airflow direction adjustment vane 31 is stationary with the distal end oriented somewhat below horizontal. The Coandă vane 32 swings between an upper position of the distal end oriented somewhat upward from the horizontal direction, and a lower position of the distal end oriented somewhat below horizontal.

When the blown air is oriented toward the occupant of the room by the airflow direction adjustment vane 31, the swinging of the Coandă vane 32 causes the blown air to come in contact with the Coandă vane 32, becoming a Coandă airflow and heading in another direction not contacting the occupant, and the occupant therefore feels that the airflow has suddenly stopped. The Coandă vane 32 then moves away from the blown air, thereby dispelling the Coandă airflow and causing the blown air to again contact the occupant, who therefore feels that an airflow has started to be blown unexpectedly.

Figure 14B:
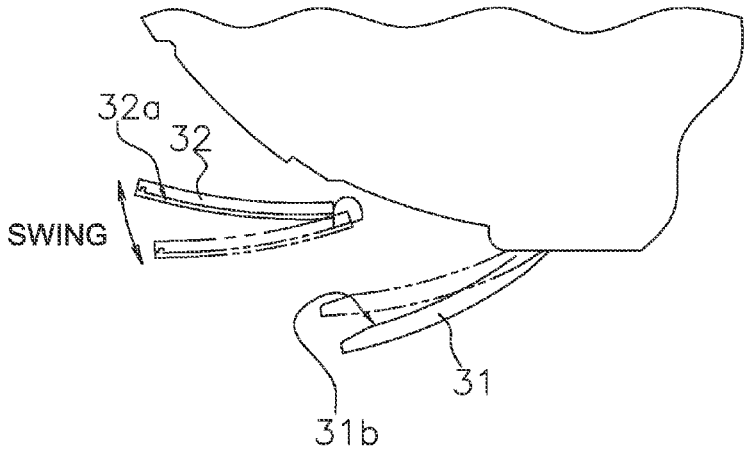
FIG. 14B is a side view of the airflow direction adjustment vane and the Coandă vane when the stationary position of the airflow direction adjustment vane in FIG. 14A has been shifted slightly downward.

FIG. 14B is a side view of the airflow direction adjustment vane 31 and the Coandă vane 32 when the stationary position of the airflow direction adjustment vane 31 in FIG. 14A has been shifted slightly downward. In FIG. 14B, every time the number of swings made by the Coandă vane 32 reaches a predetermined number, the airflow direction adjustment vane 31 moves from the current stationary position to a different stationary position. As a result, the timing at which the blown air comes in contact with the Coandă vane 32 and becomes a Coandă airflow is different from the previous instance, the timing at which the airflow contacts the occupant is therefore irregular, and this feeling of irregularity brings the airflow more closer to a natural airflow.

(6-4) Fourth Modification

Figure 15:
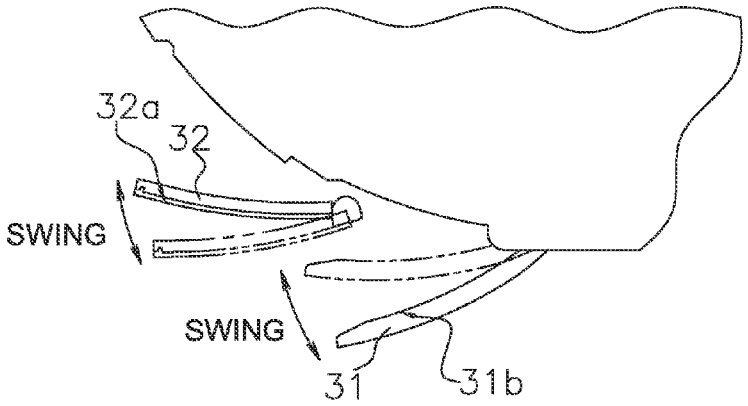
FIG. 15 is a side view of the airflow direction adjustment me and the Coandă vane of an air-conditioning indoor unit according to the fourth modification.

FIG. 15 is a side view of the airflow direction adjustment vane 31 and the Coandă vane 32 of an air-conditioning indoor unit according to a fourth modification. In FIG. 15, the airflow direction adjustment vane 31 swings between an upper position of the distal end oriented somewhat upward from the horizontal direction, and a lower position of the distal end oriented at a downward incline. The Coandă vane 32 also swings between an upper position of the distal end oriented somewhat upward from the horizontal direction, and a lower position of the distal end oriented somewhat downward from the horizontal direction. The swinging is preferably an action such that the Coandă vane 32 moves toward the lower position when the airflow direction adjustment vane 31 is moving toward the upper position.

The swinging of the airflow direction adjustment vane 31 causes the direction of the blown air to vary vertically, and the occupant of the room feels that the airflow gradually comes closer and gradually goes further away. When the airflow direction adjustment vane 31 and the Coandă vane 32 draw closer together until there is a predetermined gap in between them, the blown air comes in contact with the Coandă vane 32, thereby becoming a Coandă airflow and heading in a direction not contacting the occupant. At this time, the occupant feels that the airflow has suddenly stopped. When the airflow direction adjustment vane 31 and the Coandă vane 32 separate until there is a predetermined gap in between them and the blown air separates from the Coandă vane 32, the Coandă airflow is dispelled and the occupant feels that an airflow has started to be blown unexpectedly.

INDUSTRIAL APPLICABILITY

The present invention is useful as a wall-mounted air-conditioning indoor unit.

What is claimed is:

1. An airflow direction control device for an air-conditioning indoor unit capable of causing a flow of blown air blown out from a blow-out port to be diverted in a predetermined direction due to the Coandă effect, the airflow direction control device comprising:

a first driving unit configured to drive an airflow direction adjustment vane of the air conditioning indoor unit, the airflow direction adjustment vane being arranged and configured to vary a blowout angle of blown air relative to a horizontal plane;

a second driving unit configured to drive a Coandă vane of the air conditioning indoor unit, the Coandă vane being arranged and configured to turn the blown air into a Coandă airflow along a bottom surface thereof, the Coandă vane being provided in proximity to the blow-out port; and a control unit configured to control the first driving unit and the second driving unit and to vary incline angles of the airflow direction adjustment vane and the Coandă vane relative to a horizontal plane, the control unit being configured to control the first driving unit and the second driving unit so as to execute an airflow direction automatic switching mode that automatically switches between a Coandă effect use state in which the blown air is turned into a Coandă airflow along the bottom surface of the Coandă vane and diverted in the predetermined direction, and a normal state in which the Coandă airflow is not created, in the airflow direction automatic switching mode, the control unit being configured to keep the airflow direction adjustment vane stationary in a predetermined stationary position and to perform control to repeat a first operation and a second operation alternately, the first operation being to vary the incline angle of the Coandă vane in a predetermined vertical range so that the Coandă vane moves closer to the airflow direction adjustment vane and crosses a boundary between an area in which the Coandă effect use state occurs and an area in which the normal state occurs, the area in which the Coandă effect use state occurs and the area in which the normal state occurs being set in advance relative to the airflow direction adjustment vane stationary in the predetermined stationary position, the second operation being to vary the incline angle of the Coandă vane in a predetermined vertical range such that the Coandă vane moves away from the airflow direction adjustment vane and crosses the boundary after the first operation.

2. The airflow direction control device according to claim 1, wherein the control unit is further configured to swing the Coandă vane in the airflow direction automatic switching mode to switch between the Coandă effect use state and the normal state.

3. The airflow direction control device according to claim 1, wherein the control unit is further configured to irregularly switch between the Coandă effect use state and the normal state in the airflow direction automatic switching mode.

4. The airflow direction control device according to claim 1, wherein the control unit is further configured to regularly switch between the Coandă effect use state and the normal state in the airflow direction automatic switching mode.

5. The airflow direction control device according to claim 1, further comprising a person position detection sensor arranged and configured to detect a position of a person, in the airflow direction automatic switching mode, the airflow direction of the blown air being toward a floor in the normal state, and the airflow direction being determined based on a detection signal from the person position detection sensor.

6. The airflow direction control device according to claim 1, wherein the control unit is configured to shift the direction of the blown air when a number of cycles of varying the incline angle of the Coandă vane reaches a predetermined number.

7. The airflow direction control device according to claim 1, wherein in the Coandă effect use state, a rear end of the Coandă vane is at a lower height than when operation has stopped and the rear end of the Coandă vane enters into the flow of the blown air.

8. The airflow direction control device according to claim 1, wherein in the airflow direction automatic switching mode, the control unit varies the incline angle of the Coandă vane so that the Coandă vane repeatedly crosses between a predetermined position in an upper region outside of the blowing path and a predetermined position inside of the blowing path.

9. The airflow direction control device according to claim 8, wherein in the airflow direction automatic switching mode, the control unit varies the incline angle of the Coandă vane so that the Coandă vane repeatedly moves between a predetermined position at which a height position of a rear end portion of the Coandă vane is higher than a height position of an upper end of the blow-out port and a predetermined position at which the height position of the rear end portion of the Coandă vane is lower than the height position of the upper end of the blow-out port.

10. An airflow direction control device for an air-conditioning indoor unit capable of causing a flow of blown air blown out from a blow-out port to be diverted in a predetermined direction due to the Coandă effect, the airflow direction control device comprising:

a first driving unit configured to drive an airflow direction adjustment vane arranged and configured to vary a blowout angle of blown air relative to a horizontal plane;

a second driving unit configured to drive a Coandă vane arranged and configured to turn the blown air into a Coandă airflow along a bottom surface thereof, the Coandă vane being provided in proximity to the blow-out port; and a control unit configured to control the first driving unit and the second driving unit and to vary incline angles of the airflow direction adjustment vane and the Coandă vane relative to a horizontal plane, the control unit being configured to control the first driving unit and the second driving unit so as to execute an airflow direction automatic switching mode that automatically switches between a Coandă effect use state in which the blown air is turned into a Coandă airflow along the bottom surface of the Coandă vane and diverted in the predetermined direction, and a normal state in which the Coandă airflow is not created, in the airflow direction automatic switching mode, the control unit being configured to keep the Coandă vane stationary in a predetermined stationary position and to perform control to repeat a first operation and a second operation alternately, the first operation being to vary the incline angle of the airflow direction adjustment vane in a predetermined vertical range so that the airflow direction adjustment vane moves closer to the Coandă vane and crosses a boundary between an area in which the Coandă effect use state occurs and an area in which the normal state occurs, the area in which the Coandă effect use state occurs and the area in which the normal state occurs being set in advance relative to the Coandă vane stationary in the predetermined stationary position, the second operation being to vary the incline angle of the airflow direction vane in a predetermined vertical range and to away the airflow direction vane from the Coandă vane so that the airflow direction vane crosses the boundary after the first operation.

11. The airflow direction control device according to claim 10, wherein the control unit is further configured to swing the airflow direction adjustment vane in the airflow direction automatic switching mode to switch between the Coandă effect use state and the normal state.

12. The airflow direction control device according to claim 10, further comprising:

the control unit is configured to shift the stationary position of the Coandă vane when a number of cycles of varying the direction of the blown air reaches a predetermined number.

13. The airflow direction control device according to claim 10, wherein the control unit is further configured to irregularly switch between the Coandă effect use state and the normal state in the airflow direction automatic switching mode.

14. The airflow direction control device according to claim 10, wherein the control unit is further configured to regularly switch between the Coandă effect use state and the normal state in the airflow direction automatic switching mode.

15. The airflow direction control device according to claim 10, further comprising a person position detection sensor arranged and configured to detect a position of a person, in the airflow direction automatic switching mode, the airflow direction of the blown air being toward a floor in the normal state, and the airflow direction being determined based on a detection signal from the person position detection sensor.

16. The airflow direction control device according to claim 10, wherein in the airflow direction automatic switching mode, the control unit varies the incline angle of the airflow direction adjustment vane so that the airflow direction adjustment vane repeatedly crosses between a predetermined position in a lower region outside of the blowing path and a predetermined position inside of the blowing path.

17. The airflow direction control device according to claim 16, wherein in the airflow direction automatic switching mode, the control unit varies the incline angle of the airflow direction adjustment vane so that the airflow direction adjustment vane repeatedly moves between a predetermined position at which a front end portion of the airflow direction adjustment vane is disposed farther rearward than a rear end of the Coandă vane and a predetermined position at which the front end portion of the airflow direction adjustment vane is disposed farther forward than the rear end of the Coandă vane.

18. An airflow direction control device for an air-conditioning indoor unit capable of causing a flow of blown air blown out from a blow-out port to be diverted in a predetermined direction due to the Coandă effect, the airflow direction control device comprising:

a first driving unit configured to drive an airflow direction adjustment vane arranged and configured to vary a blowout angle of blown air relative to a horizontal plane;

a second driving unit configured to drive a Coandă vane arranged and configured to turn the blown air into a Coandă airflow along a bottom surface thereof, the Coandă vane being provided in proximity to the blow-out port; and a control unit configured to control the first driving unit and the second driving unit and to vary incline angles of the airflow direction adjustment vane and the Coandă vane relative to a horizontal plane, the control unit being configured to control the first driving unit and the second driving unit so as to execute an airflow direction automatic switching mode that automatically switches between a Coandă effect use state in which the blown air is turned into a Coandă airflow along the bottom surface of the Coandă vane and diverted in the predetermined direction, and a normal state in which the Coandă airflow is not created, in the airflow direction automatic switching mode, the control unit being configured to perform control to repeat a first operation and a second operation alternately, the first operation being to vary the incline angle of the airflow direction adjustment vane in a predetermined vertical range and to vary the incline angle of the Coandă vane in a predetermined vertical range so that the airflow direction adjustment vane and the Coandă vane move closer to each other and cross a boundary between a relative orientation in which the Coandă effect use state occurs and a relative orientation in which the normal state occurs, the relative orientation in which the Coandă effect use state occurs and the relative orientation in which the normal state occurs being set in advance, the second operation being to vary the incline angle of the airflow direction vane in a predetermined vertical range and to vary the incline angle of the Coandă vane in a predetermined vertical range and to away them each other so that the airflow direction vane and the Coandă vane crosses the boundary after the first operation.

19. The airflow direction control device according to claim 18, wherein the control unit is further configured to swing the airflow direction adjustment vane and the Coandă vane in the airflow direction automatic switching mode to switch between the Coandă effect use state and the normal state.

20. The airflow direction control device according to claim 18, wherein the control unit is further configured to irregularly switch between the Coandă effect use state and the normal state in the airflow direction automatic switching mode.

21. The airflow direction control device according to claim 18, wherein the control unit is further configured to regularly switch between the Coandă effect use state and the normal state in the airflow direction automatic switching mode.

22. The airflow direction control device according to claim 18, wherein in the airflow direction automatic switching mode, the control unit varies the incline angle of the Coandă vane so that the Coandă vane repeatedly crosses between a predetermined position in an upper region outside of the blowing path and a predetermined position inside of the blowing path and to vary the incline angle of the airflow direction adjustment vane so that the airflow direction adjustment vane repeatedly crosses between a predetermined position in an lower region outside of the blowing path and a predetermined position inside of the blowing path, and the Coandă vane moves toward the blowing path when the airflow direction adjustment vane moves toward the blowing path.

23. The airflow direction control device according to claim 22, wherein in the airflow direction automatic switching mode, the control unit varies the incline angle of the Coandă vane so that the Coandă vane repeatedly moves between a predetermined position which a height position of a rear end portion of the Coandă vane is higher than a height position of an upper end of the blow-out port and a predetermined position which the height position of the rear end portion of the Coandă vane is lower than the height position of the upper end of the blow-out port and to vary the incline angle of the airflow direction adjustment vane so that the airflow direction adjustment vane repeatedly moves between a predetermined position which a front end portion of the airflow direction adjustment vane is disposed farther rearward than a rear end of the Coandă vane and a predetermined position which the front end portion of the airflow direction adjustment vane is in disposed farther forward than the rear end of the Coandă vane, and the Coandă vane moves downward when the airflow direction adjustment vane moves upward.

* * * * *